US005579097A

United States Patent [19]

Tomoe et al.

[11] Patent Number: 5,579,097

[45] Date of Patent: Nov. 26, 1996

[54] XEROGRAPHIC PRINTING AND SHEET PROCESSING APPARATUS

[75] Inventors: Tetsuro Tomoe; Hiroaki Tsuchiya; Daisuke Hayashi; Shinichi Tanaka, all of Osaka, Japan

[73] Assignee: Mita Industrial Co., Ltd., Osaka, Japan

[21] Appl. No.: 89,377

[22] Filed: Jul. 12, 1993

[30] Foreign Application Priority Data

Jul. 13, 1992 [JP] Japan ..... 4-185137

[51] Int. Cl.[6] ..... G03G 15/20

[52] U.S. Cl. ..... 355/282; 355/309

[58] Field of Search ..... 355/282, 200, 355/290, 273, 274, 308, 271, 309, 315, 261, 285, 295; 219/216, 469–471; 432/60; 118/60

[56] References Cited

U.S. PATENT DOCUMENTS

| | | | |
|---|---|---|---|
| 4,369,729 | 1/1983 | Shigenobu et al. | 355/271 X |
| 4,806,970 | 2/1989 | Nakatomi et al. . | |
| 5,105,228 | 4/1992 | Kato | 355/282 |
| 5,166,737 | 11/1992 | Tomita | 355/308 |
| 5,285,245 | 2/1994 | Goto et al. | 355/282 X |

FOREIGN PATENT DOCUMENTS

| | | | |
|---|---|---|---|
| 0413941 | 2/1991 | European Pat. Off. . | |
| 57-072562 | 5/1982 | Japan . | |
| 58-63972 | 4/1983 | Japan . | |
| 59-55454 | 3/1984 | Japan . | |
| 59-125764 | 7/1984 | Japan | 355/315 |
| 59-210461 | 11/1984 | Japan | 355/261 |
| 60-049375 | 3/1985 | Japan . | |
| 61-107276 | 5/1986 | Japan . | |
| 61-90181 | 5/1986 | Japan . | |
| 61-163363 | 7/1986 | Japan . | |
| 62-230557 | 10/1987 | Japan . | |
| 63-244085 | 10/1988 | Japan | 355/290 |
| 1-108589 | 4/1989 | Japan | 355/290 |
| 1-185686 | 7/1989 | Japan . | |
| 2-023147 | 1/1990 | Japan . | |
| 3-043776 | 2/1991 | Japan . | |
| 3-228074 | 10/1991 | Japan . | |
| 3-249681 | 11/1991 | Japan . | |
| 4-166953 | 6/1992 | Japan . | |
| 5-006123 | 1/1993 | Japan . | |
| 5-072938 | 3/1993 | Japan | 355/290 |
| 5-162868 | 6/1993 | Japan . | |
| 5-224547 | 9/1993 | Japan | 355/290 |
| 6-004000 | 1/1994 | Japan | 355/290 |
| 0705411 | 12/1979 | U.S.S.R. | 355/290 |

OTHER PUBLICATIONS

Japanese Patent Laying–Open No. 61–130156, 1986.

Japanese Utility Model Laying–Open No. 59–120755, 1984.

*Primary Examiner*—Arthur T. Grimley

*Assistant Examiner*—Shuk Y. Lee

*Attorney, Agent, or Firm*—Beveridge, DeGrandi, Weilacher & Young, L.L.P.

[57] ABSTRACT

A sheet processing apparatus operating in xerographic printing apparatus employs a single-component magnetic toner. The inventive features of the sheet processing apparatus are directed toward smooth transportation and discharge of printing sheets sent through the printing apparatus, across a sheet transport guide, and through an image fixing and sheet transporting unit which finally discharges the printing sheets. Conductivity of the transport guide is selected by the material of which it is made, specified herein to have superficial resistivity in the range of ten thousand to one hundred million megohms. Charge applied to a printing sheet to electrostatically attract the magnetic toner during the xerographic printing is thus drained by the transport guide gradually enough not to disturb the adhesion of the toner to the sheet, yet rapidly enough to prevent the sheet from being curled upward by electrostatic attraction toward a residual toner container just over the downstream end of the guide, in the optimally compacted arrangement of the various components of the sheet processing and xerographic printing apparatus into a facsimile machine or the like.

41 Claims, 20 Drawing Sheets

XEROGRAPHIC PRINTING AND SHEET PROCESSING APPARATUS

BACKGROUND OF THE INVENTION

1. Field of the Invention

The present invention relates to xerographic printing and sheet processing apparatus, and more specifically, it relates to such apparatus included in image forming equipment for a copying machine or facsimile equipment, or the like.

2. Description of the Prior Art (1) The image forming equipment includes an image printing unit for transferring a toner-developed image onto a printing sheet and a fixing unit for fixing the toner image on the sheet. Between the image forming unit and the fixing unit, there is a transporting unit for transporting the sheet having the unfixed toner image.

When the sheet having the unfixed toner image is transported to the fixing unit, it is necessary to prevent the unfixed toner image from being damaged. Therein, Japanese Patent Publication No. 33072/1980 discloses a method for insulating a transport guide member or applying a voltage having the same polarity as that of the charge on the sheet, to the transport guide member. In addition, Japanese Patent Publication No. 59581/1989 discloses that surface resistivity of a guide member disposed on the sheet-discharging side of a transport belt is set between $1\times10^6$ Ω and $1\times10^9$ Ω. In the above disclosures, since the transport guide member or the discharge guide member has a predetermined electric resistivity, electric charge carried by the sheet is not abruptly drained, whereby the unfixed toner image is not likely to be disturbed.

Also, an imaging unit including a photoconductive drum and associated elements is usually disposed above the transport guide member. A container for collecting residual toner is provided in association with the imaging unit. If magnetic toner is used for developing the image, residual toner carrying electric charge is collected into the container.

Under these conditions, if the transport guide member is formed of an insulator as described above, the charge-carrying printing sheet tends to curl upward. More specifically, when voltage of polarity opposite to that of the electric charge of the toner is applied to the sheet in the transferring unit, the sheet will carry a charge of polarity opposite that of the residual toner, such that the sheet is curled up toward the container by electrostatic attraction, because the charge on the sheet is not drained, as the transport guide is insulated.

On the other hand, if the transport guide member is formed of a good conductor, the electric charge on the printing sheet is abruptly drained through the transport guide member. Consequently, adhesion of the unfixed toner image to the sheet is broken or reduced, causing the image to be damaged.

Therefore, as disclosed in Japanese Patent Publication No. 59581/1989, it is proposed that the surface resistivity of the transport guide member is set between $1\times10^6$ Ω and $1\times10^9$ Ω. However, where the transport guide member is relatively long, even if the surface resistivity is set as described above, the electric charge on the sheet is likely to be over-drained. Consequently, the electrostatic adhesion of the unfixed toner to the sheet is reduced during printing sheet transportation, and the unfixed toner image can suffer damage.

(2) The image fixing unit for fixing the toner image formed on the sheet surface in the image forming apparatus includes a heating roller having a heater inside and a pressure roller pressing against the heating roller. As the sheet is transported between the rollers, the toner image on the sheet is fixed.

According to the above fixing unit, since the heating roller is pressed against the pressure roller, if the rollers are left stationary in that state, or are in that state during a long transport, the rollers might become deformed. In order to avoid this, a spacer is inserted between both ends of both rollers to release the pressure between both rollers when shipped, for example. Alternatively, one roller is separated from the other by a lever or a cam to release the pressure between them.

In conventional art, however, both rollers have to be pressed to each other when set up in installation; otherwise, failure in the image fixing operation will arise.

(3) In the fixing unit, a temperature fuse is installed in order to prevent the heating roller from becoming overheated, for example, due to malfunction in an associated temperature controller. The temperature fuse is disposed close to the heating roller and melts when the heating roller heats up abnormally, interrupting supply of power to the heating roller heater.

In order to dispose the temperature fuse immediately adjacent the heating roller, at a small gap, it is necessary to precisely adjust the distance between the temperature fuse and the heating roller. In this case, a thickness gauge is used for adjusting the gap.

However, when the thickness gauge is inserted between the heating roller and the temperature fuse, the gauge contacts the surface of the heating roller and is liable to damage it. The adjusting operation is moreover cumbersome and time-consuming.

(4) In the image fixing unit, a mechanism for releasing the pressure between the rollers is provided to facilitate handling when a printing sheet gets jammed between the rollers.

Various mechanisms have been proposed for releasing the pressure between the roller pair, viz., the rollers are each mounted to a separate frame and the pair of frames is openable; a lever is mounted to one roller and the lever is operated by, for example a cam functioning to release the pressure; or a lever is rotatably mounted to, for example a side plate supporting the rollers and a bearing supporting one roller is moved by one end of the lever to release the pressure.

According to the foregoing conventional pressure releasing mechanism described above in which each of the pair of rollers is mounted to a different frame, the side plate supporting the rollers is split, which increases production costs. In the conventional mechanism employing the lever and the cam, the number of parts is increased, complicating the structure. According to that of the conventional mechanism mentioned in which the bearing of one roller is moved by one end of a lever, wherein the bearing is to be moved by a small force, the mechanical advantage of the lever must be high; it must consequently be long.

(5) A discharge roller unit is provided to discharge the sheet having the fixed image from the image fixing unit into the sheet discharge tray. The discharge roller unit includes a pair of rollers. The image-fixed sheet is transported to the discharge tray pinched between the pair of rollers. The pair of rollers consists of an upper roller and an lower roller having teeth on its outer periphery. The trailing edge of the sheet is pushed in the discharging direction by the teeth to be discharged. Alternatively, a lower roller along which is a peripherally stepped ridge can be used, in which case the trailing edge of the sheet is pushed in the discharging direction by the stepped portion.

According to the conventional unit using the roller having the teeth on its outer periphery, when the trailing edge of the sheet is pushed in the discharging direction by the teeth, the trailing edge of the sheet is moved along an adjacent edge of the tooth outward in the radial direction. Therefore, while the roller is rotated through a predetermined angle, sometimes the trailing edge of the sheet comes out of contact against the edge of the tooth. Consequently, the sheet cannot be discharged to the discharge tray.

On the other hand, the rotation of the roller having the stepped portion is occasionally halted in a position in which the stepped portion projecting in a ridge along the roller periphery abuts on the upper roller.

(6) There is provided an image forming apparatus comprising an imaging unit including a photoconductive drum and a developing unit including a develop roller and associated elements, which units are detachably mounted on an image forming equipment body. In maintenance, each of these units can be entirely replaced, whereby the maintenance operations are facilitated.

As the units are not mounted in the image forming equipment body when shipped, each unit is installed therein in setting up the equipment. The units are also detached when a printing sheet becomes jammed or when parts are replaced.

When the imaging unit is mounted or dismounted, sufficient space should be provided between the photoconductive drum and an associated member such as the develop roller for example, so as to ensure that they are prevented from coming into contact with each other. Meanwhile, wherein these units are properly positioned in installation, the photoconductive drum must be disposed immediate to the develop roller. Therefore, a guide rail or a positioning member of a specific configuration is provided in the mounting position of the imaging unit, whereby the imaging unit can be separated from the develop roller when mounted or dismounted, and can be brought immediate the develop roller at a predetermined spacing when set into its correct right position.

More specifically, according to the conventional apparatus, a special member for bringing such units into predetermined positions and correctly setting them therein is necessary.

SUMMARY OF THE INVENTION

Object

It is an object of the present invention to prevent a printing sheet in xerographic printing apparatus from being curled upward and further to prevent damage to an unfixed toner image on a printing sheet.

It is another object of the present invention to provide for the separation of sheet processing unit rollers while left in long term storage, and to assure they come into surely pressing contact against each other during use.

It is still another object of the present invention to facilitate the operation for adjusting the gap between the temperature fuse and the heating roller.

It is still another object of the present invention to allow sheet processing unit rollers to be separated by a small force.

It is yet another object of the present invention to improve sheet-discharging performance therein by means of a simple mechanism, and to eliminate potential damage to the sheet.

It is yet another object of the present invention to fix sheet processing units to a body frame of image forming equipment by a simple structure.

Means (1) According to a first aspect of the present invention, a xerographic printing and sheet processing apparatus for an image forming apparatus includes an image printing apparatus for printing onto a sheet an image developed with magnetic toner from a latent image; a residual toner container for collecting toner residual from the image printing apparatus; and a transport guide member, disposed in a position opposite the residual toner container, for guiding a printing sheet from the image printing apparatus in transport in a sheet-discharging downstream direction of the image forming apparatus.

The transport guide member has a surface resistivity ranging from $1\times10^{10}$ Ω to $1\times10^{14}$ Ω. Thus, since electric charge on the sheet is drained gradually, the sheet is prevented from being curled up toward the residual toner container. Furthermore, since adhesion of the unfixed toner image to the sheet is not likely to be abruptly reduced, the image is not damaged.

(2) According to a second aspect of the present invention, a xerographic printing and sheet processing apparatus for an image forming apparatus includes an image printing apparatus for printing onto a sheet an image developed with magnetic toner from a latent image; a residual toner container for collecting toner residual from the image printing apparatus; a transport guide member, disposed in a position opposite the residual toner container, for guiding a printing sheet from the image printing apparatus in transport in a sheet-discharging downstream direction of the image forming apparatus; and a grounded conductive material disposed immediate the residual toner container and above the transport guide member.

According to this aspect of the present invention, since the conductive member disposed immediate the residual toner container is grounded, the conductive member is induced by electrostatic induction to carry electric charge of polarity opposite that of the electric charge of the residual toner. Therefore, even if the printing sheet, carrying charge of polarity opposite that of the toner, passes under the container, electrostatic attraction is not generated therebetween. Consequently, the sheet is not made to curl upward.

(3) The invention further relates to a xerographic printing and sheet processing apparatus of image forming equipment supported on an equipment body frame and comprises an image printing apparatus detachably installable into the body frame, a sheet transport unit according to a third aspect of the present invention includes a pair of sheet transport mechanisms, positionable into a pressed together position for transporting a sheet, and positionable into a parted position in which the sheet transport mechanisms are separated from each other; and it further includes a sheet transport mechanism positioning controller for maintaining the pair of sheet transport mechanisms in the parted position wherein the image printing apparatus is withdrawn from the body frame, and for bringing the pair of sheet transport mechanisms retentively into the pressed together position, wherein a positioning part of the sheet transport mechanism positioning controller abuts on a corresponding portion of the image printing apparatus when the image printing apparatus is installed into the body frame.

According to the above aspect of the present invention, the pair of sheet transport mechanisms automatically positionable into the pressed together position or into the parted position according to whether the image printing apparatus is mounted or not, whereby operation failure caused by damaging error in handling the various parts is preventable. Furthermore, since the positioning of the pair of sheet transport mechanisms is controlled while one portion of the position controller directly abuts on the image printing apparatus, its structure is simplified.

(4) The invention further relates to a xerographic printing and sheet processing apparatus of image forming equipment supported on an equipment body frame and comprises an image printing apparatus detachably installable into the body frame, a sheet transport unit according to a fourth aspect of the present invention includes a pair of sheet transport mechanisms, positionable into a pressed together position for transporting a sheet, and positionable into a parted position in which the sheet transport mechanisms are separated from each other; and it further includes a sheet transport mechanism positioning controller and a positioning actuator. The positioning actuator is moved into a first position wherein the image printing apparatus is withdrawn from the body frame, and is moved into a second position by the image printing apparatus wherein it is installed into the body frame. The positioning controller is for maintaining the pair of sheet transport mechanisms in the parted position when the image printing apparatus is withdrawn from the body frame, and for bringing the pair of sheet transport mechanisms retentively into the pressed together position, when image printing apparatus is installed into the body frame.

According to the above aspect of the present invention, the positioning actuator is moved according to whether the image forming unit is in installation or not, and the pair of sheet transport mechanisms of the sheet transport unit is pressed together or separated according to the position of the moving member. Therefore, when the apparatus is not used for a long time, or when shipped, the pair of sheet transport mechanisms is kept in the parted position. When the image forming equipment is set up for, the sheet transport mechanisms are automatically positioned into the pressed together position when the image printing unit is installed. Consequently, operation failure caused by handling errors, is preventable, as is shipping damage of the associated parts.

(5) For image forming apparatus comprising xerographic printing and sheet processing apparatus including an image printing apparatus, a sheet discharge unit for discharging a sheet supplied from the image printing apparatus according to a fifth aspect of the present invention includes a sheet transport unit and a rotatable feed roller. The transporting unit has a circulating surface for transporting a supplied image-fixed printing sheet. Upon supply of the printing sheet to the feed roller, it pinches the sheet together with the circulating surface of the sheet transport means in order to discharge the sheet. The feed roller has at least one peripheral axially-cut groove into which an edge of the sheet trailing in discharge will drop, wherein the trailing edge of the sheet is guided by an adjacent side of the groove radially inward along the groove side, following rotation of the feed roller.

According to the above aspect of the present invention, as the feed roller pushes the trailing end of the printing sheet in the discharging direction, the trailing edge of the sheet does not come out of the groove, consequently ensuring secure discharge of the sheet.

(6) In an image forming apparatus including an image printing apparatus for printing onto a sheet a toner-developed image, a fixing unit according to a sixth aspect of the present invention includes an image fixing part, a fixing unit housing and a temperature fuse.

The fixing part includes a heating roller containing a heater for superficially fixing the printing of the toner-developed image onto the printing sheet when supplied from the image printing apparatus. The fixing unit housing is provided with cutouts forming a fuse catch; and it covers the heating roller, having a lateral wall immediate adjacent to it. The temperature fuse is electrically connected to the heater and is retained by the fuse catch so as to leave a predetermined gap between the temperature fuse and the heating roller.

According to the above aspect of the present invention, when the temperature fuse is mounted, a portion thereof is received through the cutouts in the housing, making it easy to adjust the space between the temperature fuse and the heating roller precisely and quickly.

(7) A sheet transport unit installable in a xerographic printing and sheet processing apparatus of image forming equipment according to a seventh aspect of the present invention includes first and second transport mechanisms, an impelling unit, a cam device and an operating unit for rotating the cam device.

The first transport mechanism includes a circulating first sheet-transport surface and a rotator rod for rotating the first sheet transport surface. The second transport mechanism includes a second sheet transport surface pressible against the first sheet transport surface and separable therefrom, for transporting a printing sheet by pinching the sheet together with the first sheet transport surface. The impelling unit impels the second sheet transport surface against the first sheet transport surface. The cam device is rotatably disposed peripherally around an end of the rotator rod, and carries a cam for separating the second sheet transport surface from the first sheet transport surface against impelling force of the impelling unit.

According to the above aspect of the present invention, since the cam device, serving as a lever, is disposed peripherally of the rotator rod wherein the rotation center of the cam device coincides with the axis of the rotator rod, it is installable in a compact space. Furthermore, since both sheet transport surfaces are separable by rotation of the cam, the force for separating them can be small, as afforded by the configuration of the cam.

(8) For a xerographic printing and sheet processing apparatus of image forming equipment, a detachable sheet transport unit mounting structure for pressing a sheet transport unit in one direction and for mounting said sheet transport unit into a body frame of the image forming equipment according to an eighth aspect of the present invention includes a pair of sheet transport members, a pressing mechanism, a pressure releasing member and an impelling member. The pair of transport members is positionable into a pressed together position for transporting a sheet, and positionable into a parted position. The pressing mechanism, under impelling force of the impelling member, presses the pair of sheet transport members together. The pressure releasing member is positionable into a first position, for separating the pair of sheet transport members, and a second position, for allowing the pair of transporting members to be pressed together by the pressing mechanism. In addition, the pressure releasing member being in the first position presses the impelling member so as to separate against its impelling force one of the pair of sheet transport members from the other.

According to the above aspect of the present invention, since the sheet transport unit mounting structure is positioned in the body frame by means of the pressing mechanism and associated elements of the pair of transport members, the unit is thus positionable into a predetermined location by a mechanism of simple structure.

DESCRIPTION OF THE PREFERRED EMBODIMENTS

Figure 1:
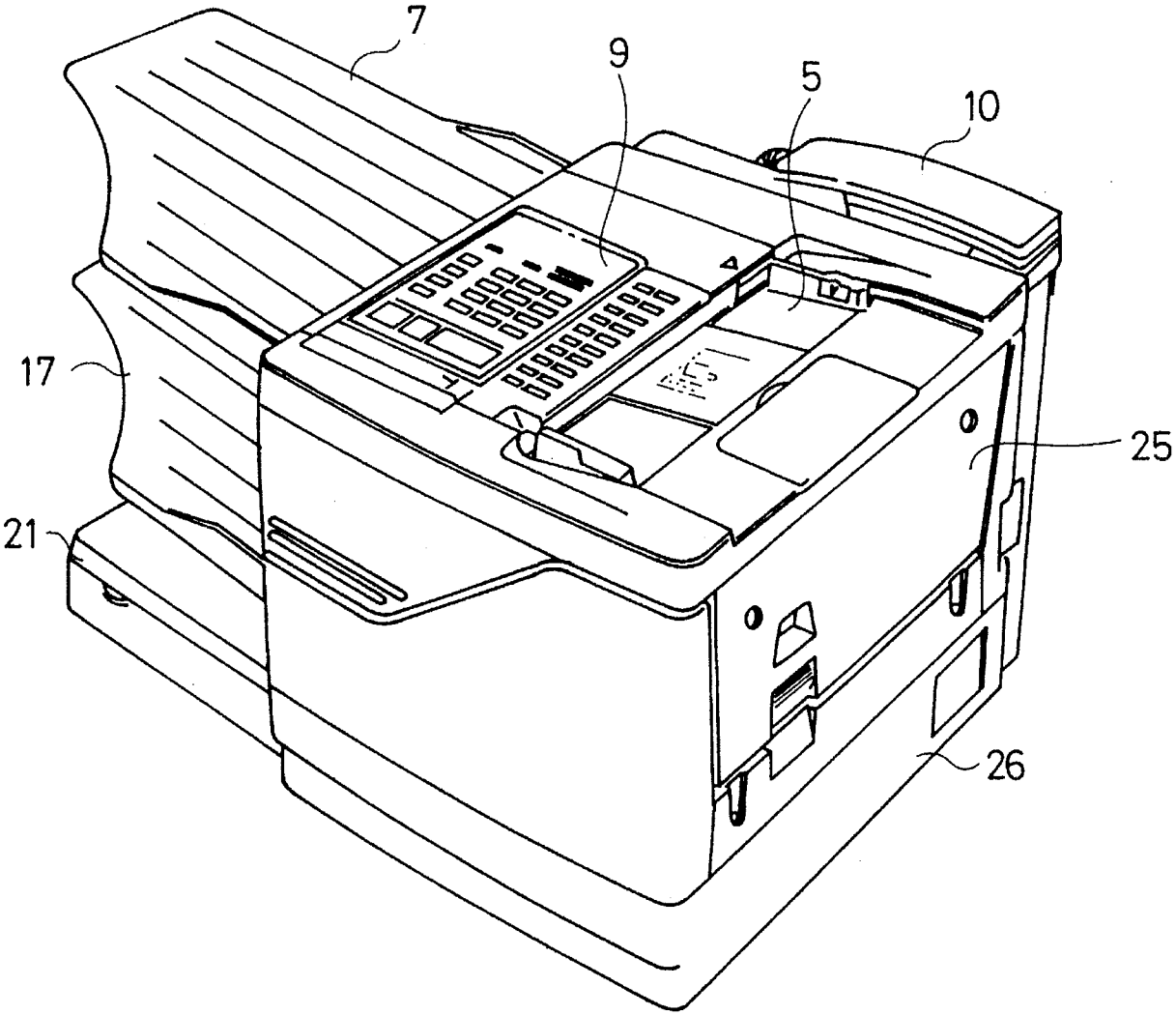
FIG. 1 is a schematic perspective view showing a facsimile terminal employing image forming equipment according to an embodiment of the present invention.
Figure 2:
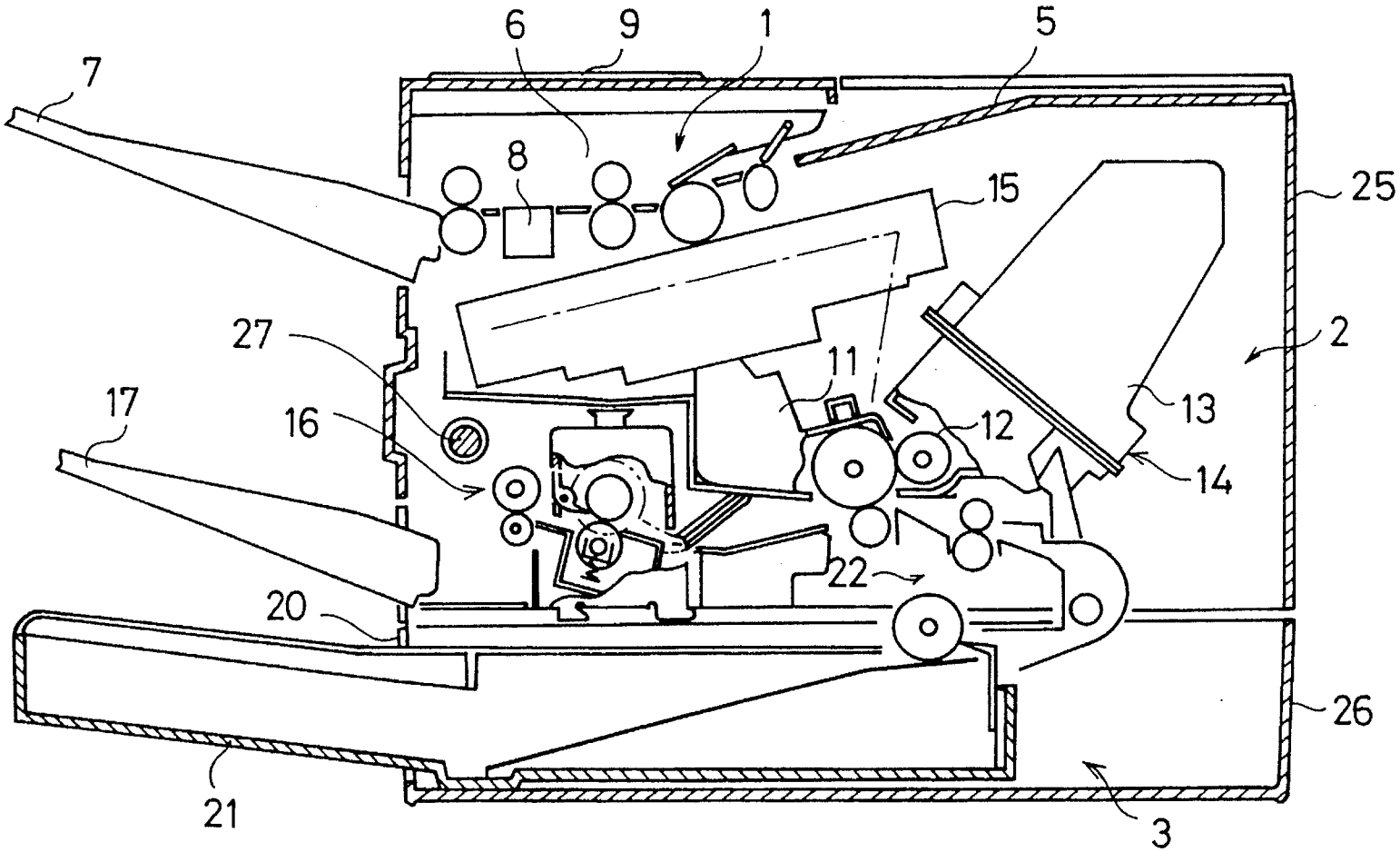
FIG. 2 is a schematic vertical section corresponding to FIG. 1.

Reference is made to FIG. 1, schematically illustrating in perspective view a facsimile terminal comprising image forming equipment in accordance with an embodiment of the present invention. Reference is additionally made to FIG. 2, a vertical section providing a schematic view through the facsimile terminal.

Therein, the image forming equipment is shown chiefly to comprise a reading part 1 for reading image information of an original document put into an upper portion of the equipment, xerographic printing and sheet processing apparatus 2 disposed in the center of time equipment, receiving the image information and printing it onto a sheet, and a sheet feeding part 3 disposed at the bottom of the equipment, for feeding copying sheets to the xerographic printing and sheet processing apparatus 2.

The reading part 1 includes an original retainer 5 on which the original is put, an original-transport section 6 for transporting the original, and an original-discharge tray 7 for storing originals discharged from the original-transport part 6. In the original-transport section 6, a sensor 8 for reading image information of the original is disposed. An operation panel 9 comprising various keys and a display is disposed on the upper surface of the equipment. In addition, a hand set 10 is disposed along an upper portion of the equipment. The xerographic printing and sheet processing apparatus 2 includes an imaging unit 11 comprising a photoconductive drum and associated elements, a developing unit 14 comprising a developing roller 12 and a toner cartridge 13, containing magnetic, single component toner, a laser unit 15 for forming on the surface of the photoconductive drum of the imaging unit 11 a latent image according to the information received, and an image fixing and sheet transport unit 16 for fixing an image printed from developing toner onto the sheet surface by the imaging unit 11. On the left of the image fixing and sheet transporting unit 16 in the figure, a sheet discharge tray 17 is provided. The feeding part 3 includes a feed cassette 21 which is detachably mounted in an opening 20 provided in the bottom portion of the equipment body, and a sheet-feeding unit 22 for feeding sheets from the feeding cassette 21 and supplying them to the xerographic printing and sheet processing apparatus 2.

The equipment body consists of an upper case 25 and a lower case 26. The upper case 25 is openable on a hinge 27. The upper case 25 contains the reading part 1 and the imaging unit 11, as well as the developing unit 14 and the laser unit 15 of the xerographic printing and sheet processing apparatus 2. The lower case 26 holds the image fixing and sheet transporting unit 16 of the xerographic printing and sheet processing apparatus 2, and the feeding part 3.

Figure 3:
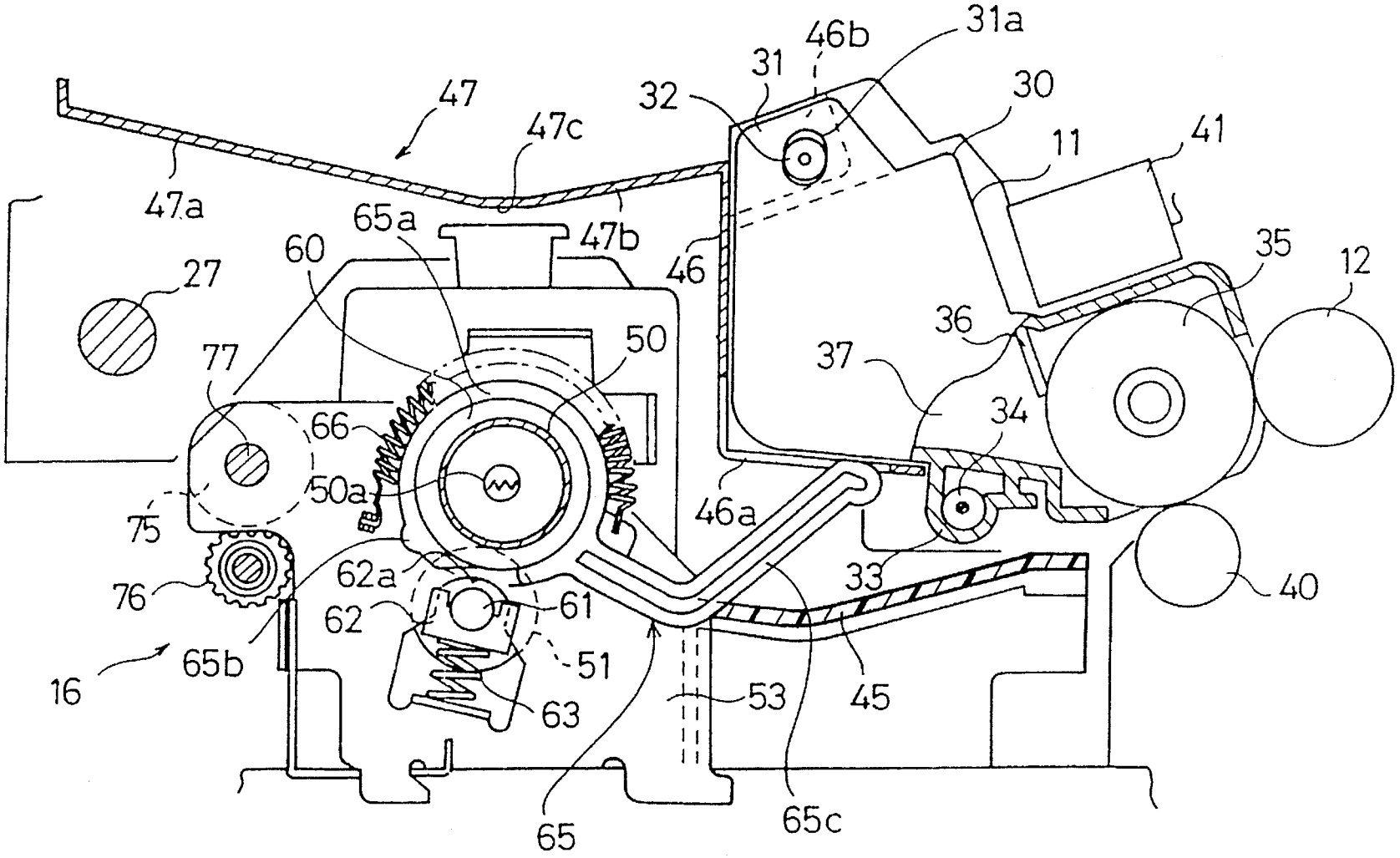
FIG. 3 is a detailed partial enlargement corresponding to FIG. 2, illustrating an image forming apparatus, and an image fixing and sheet transporting unit of the equipment.

Referring now to FIG. 3, the imaging unit 11 and the image fixing and sheet transporting unit 16 of the xerographic printing and sheet processing apparatus 2 are depicted in detail in an enlarged partial view.

The imaging unit 11 is housed within a housing 30. Upwardly protruding mounting flanges 31 are formed at the upper ends of sides of the housing 30. A vertically extending slot **31*a* is formed in each mounting flange 31 and the slot 31*a* holds a pin 32 provided in a body frame of the facsimile equipment. Thus, the imaging unit 11 is vertically movable within a predetermined range. Furthermore, downward projecting retainers 33 are formed at lower portions of the housing 30. The retainers 33 receive pins 34 likewise provided. In the body frame, positioning the imaging unit 30 in the vertical direction. A photoconductive drum 35 is rotatably mounted in the end of the imaging unit 11 adjacent the developing unit 14. A cleaning blade 36 for removing toner residual on the surface of the photoconductive drum 35 is provided alongside the photoconductive drum 35. The residual toner removed from the surface of the photoconductive drum 35 by the cleaning blade 36 is collected into a residual toner container 37 defined by the housing 30**.

A transfer roller 40, printing the toner-developed image on the photoconductive drum 35 by transferring it onto the sheet, is disposed under the photoconductive drum 35. The transfer roller 40 is rotatably supported by the frame of the lower case 26. A main charger 41 for charging the surface of the photoconductive drum 35 is disposed above it.

Thus, an image printing apparatus for printing a toner-developed image onto the surface of a sheet consists of the imaging unit 11, the developing unit 14, the transfer roller 40 and the main charger 41. In this embodiment of the present invention, since the photoconductive drum 35 is negatively charged and the toner carries positive electric charge, the sheet is accordingly charged by the transfer roller 40 to have negative polarity.

A sheet transport guide 45 for guiding the sheet bearing the printed toner image toward the image fixing and sheet transporting unit 16 is disposed downstream from the image printing apparatus in a sheet-discharging direction of the image forming equipment. The sheet transport guide 45 is formed of a resin providing controlled conductivity. In this embodiment, a resin having superficial resistivity ranging from $1\times10^{10}\Omega$ to $1\times10^{14}\Omega$ is used. For example, Toray Industries' "TOYOLACPAREL TP10" (superficial resistivity: $1\times10^{11}\Omega$), or Japan Synthetic Rubber, Ltd.'s "ABS EM12" (superficial resistivity: $2\times10^{11}\Omega$) can preferably be used. Above the sheet transport guide 45, a middle frame 46 is disposed immediate the imaging unit 11. The middle frame 46 is formed of, for example, iron plate, wherein it is an electric conductor. The middle frame 46 is in contact with the imaging unit 11 through the flanges **46*b* and is grounded through another frame. Two cutouts 46*a*** are formed in the middle frame corresponding to opposite sides widthwise of the printing sheet.

Figure 4:
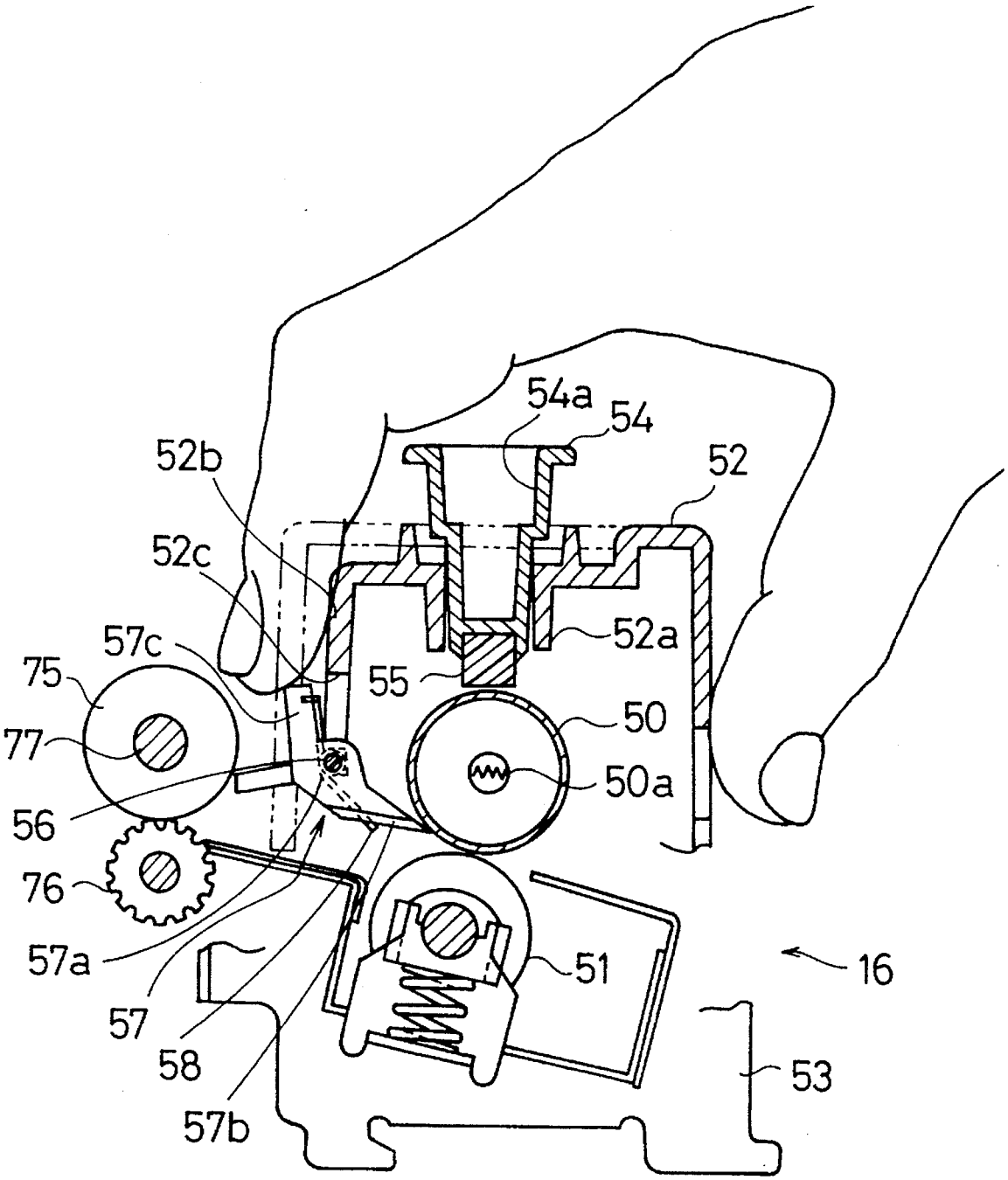
FIG. 4 is a partial view in vertical section of the unit.

Referring to FIGS. 3 and 4, the image fixing and sheet transporting unit 16 includes a heating roller 50, inside which is a heater **50*a*, against which a sheet transport pressure roller 51 is pressible. A fixing unit upper housing 52 surroundingly covers the heating roller 50. The upper housing 52 extends axially along the heating roller 50 and is detachably mounted on a lower housing (not shown). The lower housing is fixed to frames 53 of a pair which is provided flanking the axial ends of the rollers 50 and 51. A channel 52*a* through which a mounting member 54 is detachably inserted is formed in the central portion of the upper wall of the upper housing 52 along the axial direction of the rollers. The mounting member 54 has a central cavity 54*a*. A cleaning element 55 for cleaning the surface of the heating roller 50 is mounted in the bottom of the mounting member 54. Two cutouts 52*c* are formed in lateral wall 52*b* of the upper housing 52 on the sheet-discharging side along the axial direction of the rollers. A support pin 56 is located in each cutout 52*c*. A separating claw 57 for separating a sheet in transport from the heating roller 50 is rotatably supported on each support pin 56. Each separating claw 57 comprises a support portion 57*a* supported on the corresponding support pin 56, a separator portion 57*b* extending from the support portion 57*a* toward the heating roller 50 and a lever portion 57*c* extending from the support portion 57*a* to the exterior side of the lateral wall 52*b*. The separator portion 57*b* is pressed against the surface of the heating roller 50 by a torsion spring 58. The lever portion 57*c* protrudes from the cutout 52*c* and is thus exposed to the exterior side of the lateral wall 52*b*. When the upper housing 52 is mounted or dismounted, an operator pushes a lever portion 57*c* toward the side wall 52*b* as shown in FIG. 4, in order that the end of the separator portions 57*b* be lifted off the surface of the heating roller 50**.

By means of the separating claw 57, a sheet which in undergoing image fixing tends to wind around the surface of the heating roller 50 is readily detached therefrom. Furthermore, when the upper housing 52 is mounted or dismounted, for example for parts replacement, the end of the separating claw 57 is securely separable from the surface of the heating roller 50 by holding the lever portion **57*c*, whereby potential damage therein to the heating roller surface 50** is prevented.

Referring to FIG. 3, the heating roller 50 is rotatably supported on the frame 53 by a bearing 60. Additionally, a rod 61 of the pressure roller 51 is supported on the frame 53 through a bearing 62 and a spring 63. A knob **62*a* projecting upward is provided on the upper portion of the bearing 62. The bearing 62 is vertically shiftable and is constantly impelled against the heating roller 50 by the elasticity of the spring 63. The bearings 60 and 62, and the spring 63**, are disposed at either end of the roller.

Peripherally around each of the pair of bearings 60 supporting the heating roller 50, a pressure releasing lever 65 is rotatably mounted, concentric with the heating roller 50. Each of the pair of pressure releasing levers 65 includes a retaining ring **65*a* peripherally encircling the bearing 60, a cam 65*b* formed in a portion of the retaining ring 65*a*, from which an L-shaped lever arm 65*c* extends toward the image forming unit. One end of the pressure releasing lever 65 is impelled counterclockwise in FIG. 3 by a spring 66 retained by the frame 53. When the imaging unit 11 is mounted into the imaging forming equipment, the ends of the lever arms 65*c* pass through the cutouts 46*a* of the middle frame 46 and abut on the bottom surface of the housing 30. Thus, each lever arm 65*c* is rotated clockwise against the impelling force of the spring 66. In this state, the cam 65*b* is turned away from the knob 62*a* of the pressure roller 51 bearing 62. Therefore, the pressure roller 51 is elastically pressed against the thermal roller 50 by the spring 63**.

Figure 5:
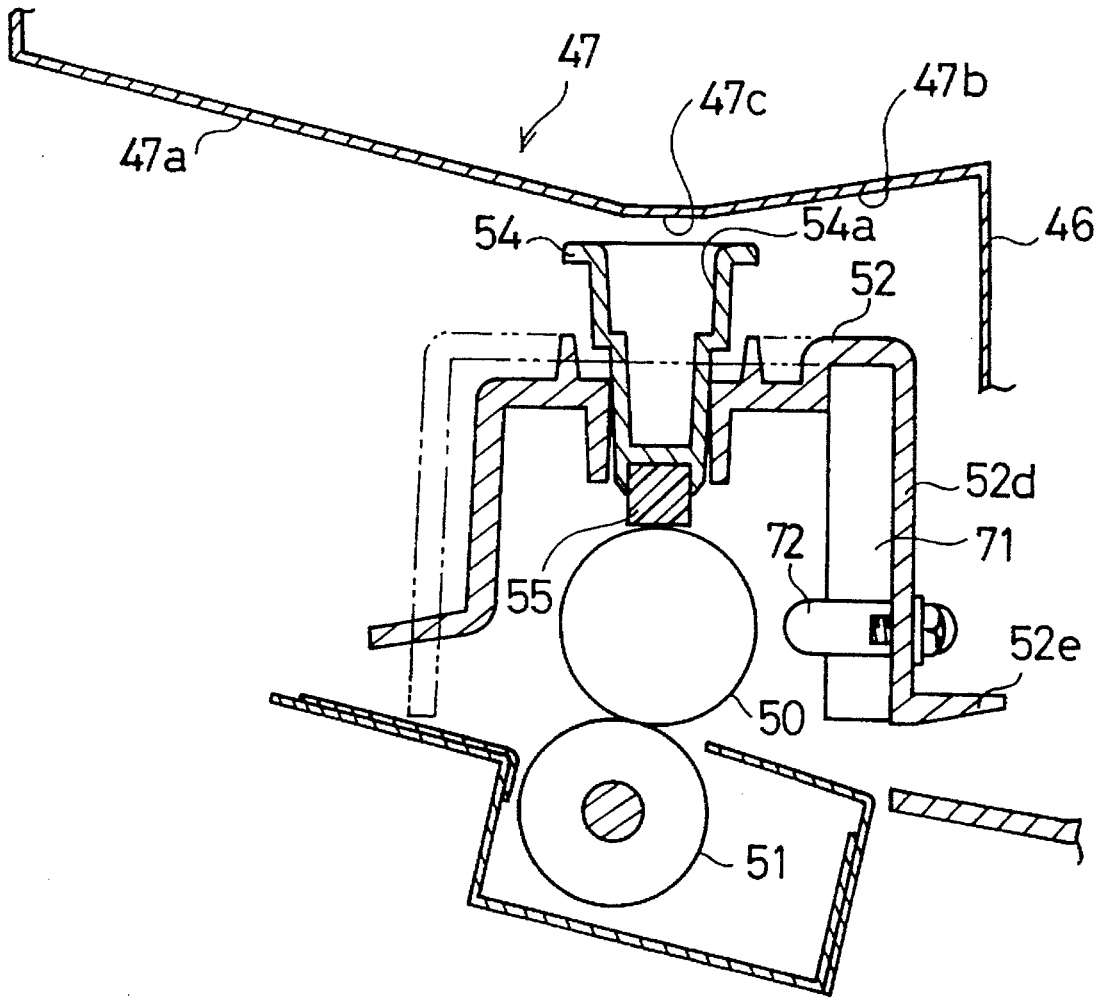
FIG. 5 is a view corresponding to FIG. 4, illustrating an installed temperature fuse of the unit.
Figure 6:
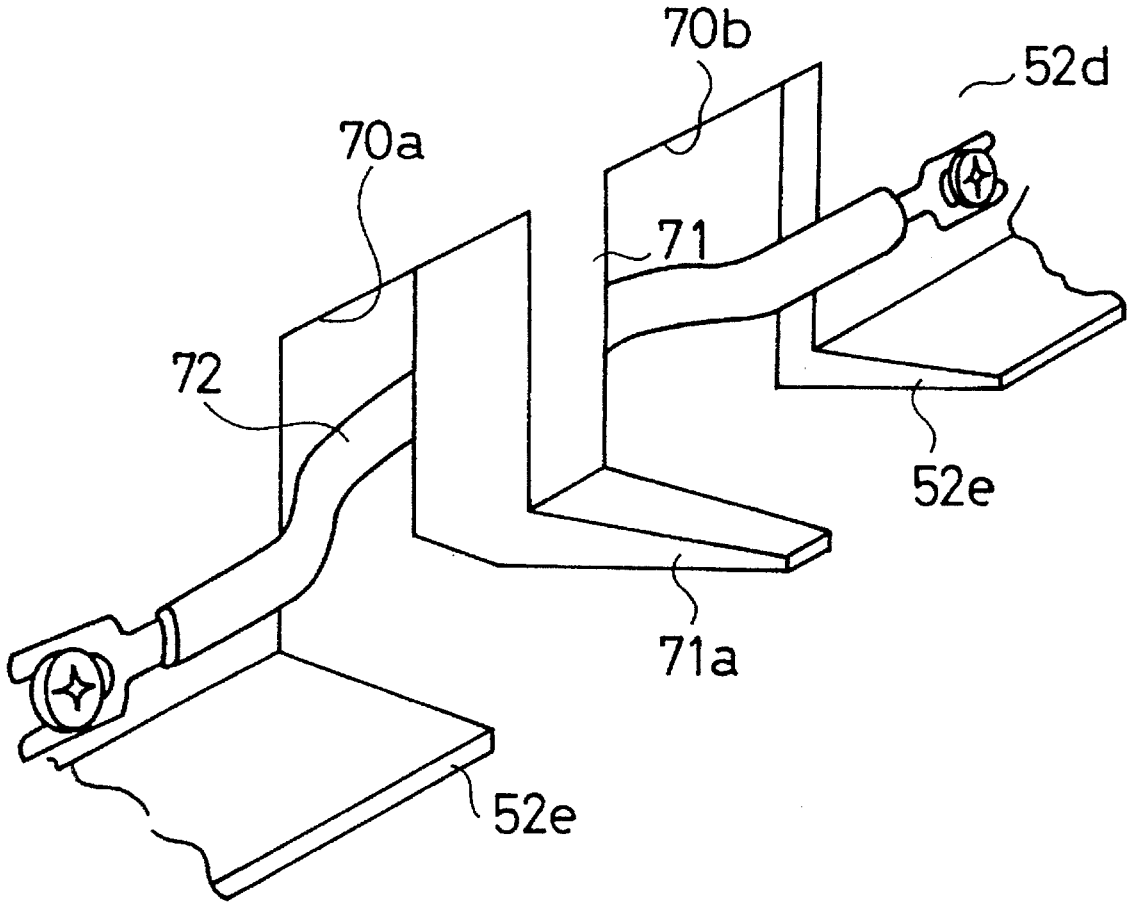
FIG. 6 is a perspective view showing a temperature fuse mounting portion in a housing of the unit.

Referring to FIGS. 5 and 6, two cutouts **70*a* and 70*b* are formed in the lateral wall 52*b* of the upper housing on the side toward the image printing unit and a fuse catch 71 is formed between the cutouts 70*a* and 70*b*. A temperature fuse 72 is laced through along the interior side of the housing 52 and both ends of the temperature fuse 72 are fixed to the exterior surface of the housing lateral wall 52*d* by screws. Although not shown, the heater 50*a* inside the heating roller 50 is electrically wired to the fuse 72 ends fixed by the screws. Thus, as the temperature fuse 72 is installed immediate the heating roller 50**, the distance between them is easily and precisely adjustable.

Guides **52*e* and 71*a* are formed at the lower ends of the lateral wall 52*d* and the catch 71, respectively, whereby a supplied printing sheet is guided as it is introduced between the heating roller 50 and pressure roller 51**.

As shown in FIGS. 3 and 5, the middle frame 46 extends out over the image fixing and sheet transporting unit 16 and serves as a partition 47 between the image fixing and sheet transporting unit 16 and the image forming equipment upper portion. The partition 47 includes dihedral surfaces **47*a* and 47*b* meeting in a lowest collecting surface 47*c* above the mounting member 54, wherein waterdrops forming along the dihedral surfaces 47*a* and 47*b*** collect.

Figure 7:
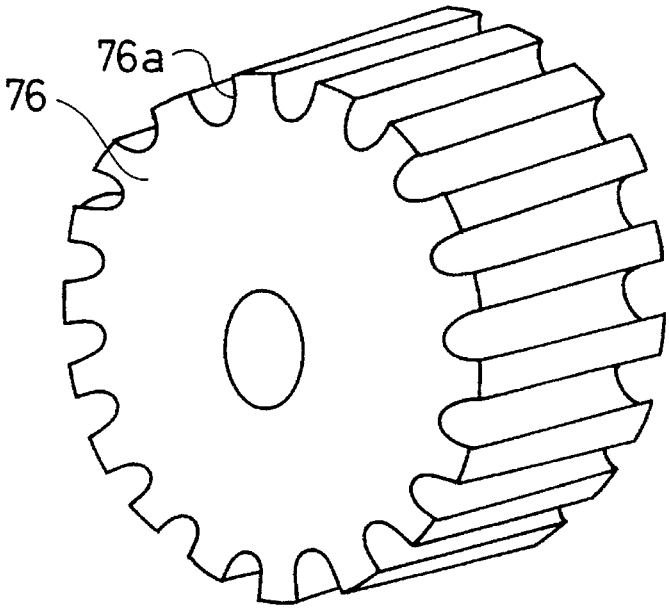
FIG. 7 is a perspective view showing a lower roller of the unit.
Figure 8:
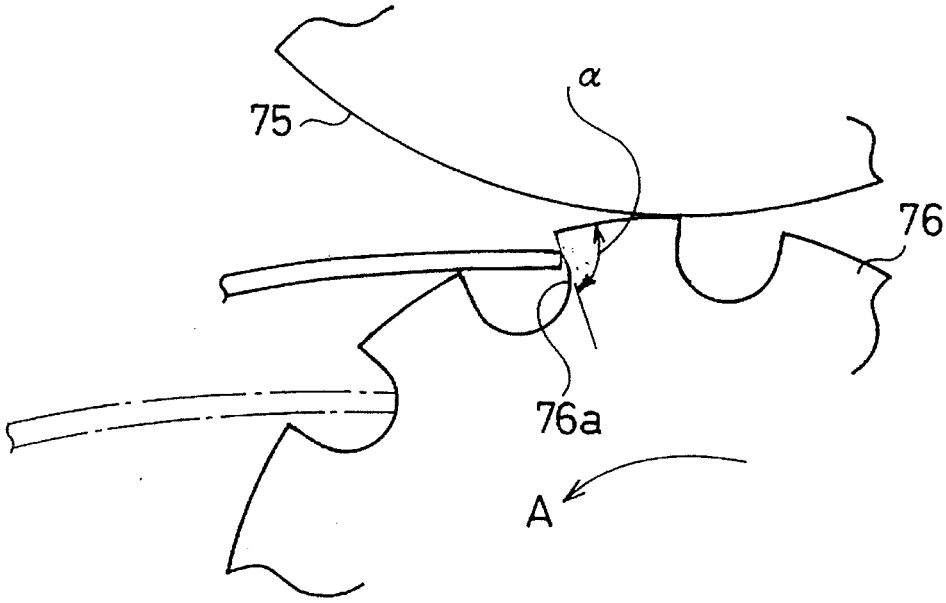
FIG. 8 is a enlarged partial view showing the lower roller in contact against a heating roller of the unit.

As shown in FIGS. 3 and 4, a pair of sheet discharge rollers 75 and 76 is disposed downstream of the image fixing and sheet transporting unit 16. The upper roller 75 is fixed to a drive shaft 77 supported on the frame 53. The lower roller 76 is rotatably supported in the lower housing (not shown). The lower roller 76 is formed of a resin such as POM (polyacetal) and has a plurality of axially-cut peripheral grooves **76*a* fluted to be U-shaped sectionally, as shown in FIGS. 7 and 8. The lower roller 76 is substantially cylindrical being, for example, 12 mm in outside diameter, 4.3 mm inside diameter and 8 mm in thickness; and each groove 76***a* is 1.2 mm in width, there being fifteen circumferentially equidistant grooves. As enlargedly shown in FIG. 8, the groove is cut such that an angle α, between the side of the groove and a line tangent to the cylindrical surface of the lower roller 76 is determined to be 90° or less. Therefore, when the lower roller 76 is rotated in the direction indicated by arrow A in FIG. 8 to discharge the sheet, the trailing edge of the sheet will drop into the groove. Thus, the sheet is surely discharged toward the discharge tray 17.

Figure 9:
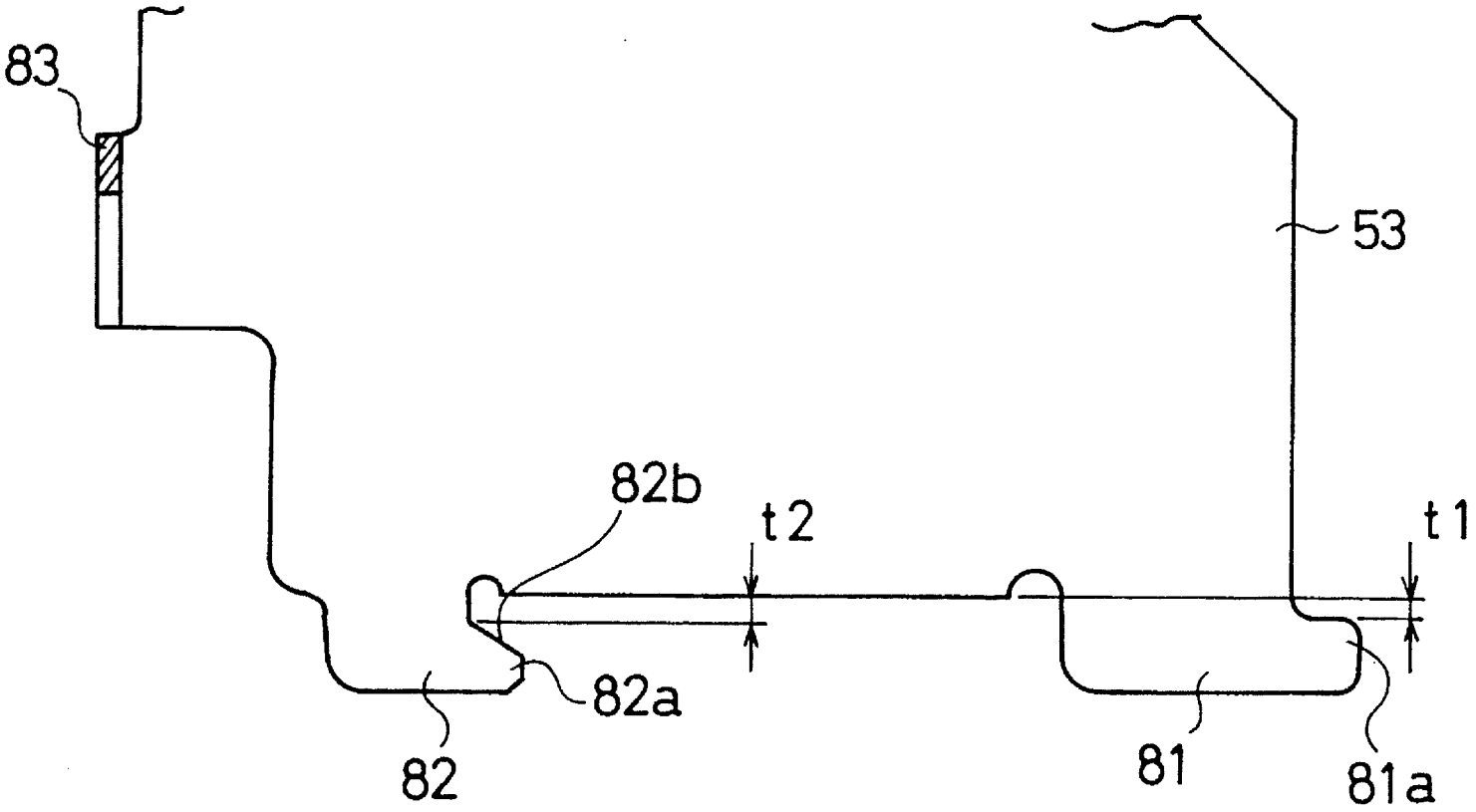
FIG. 9 is a partial elevational view of a frame of the unit.
Figure 10:
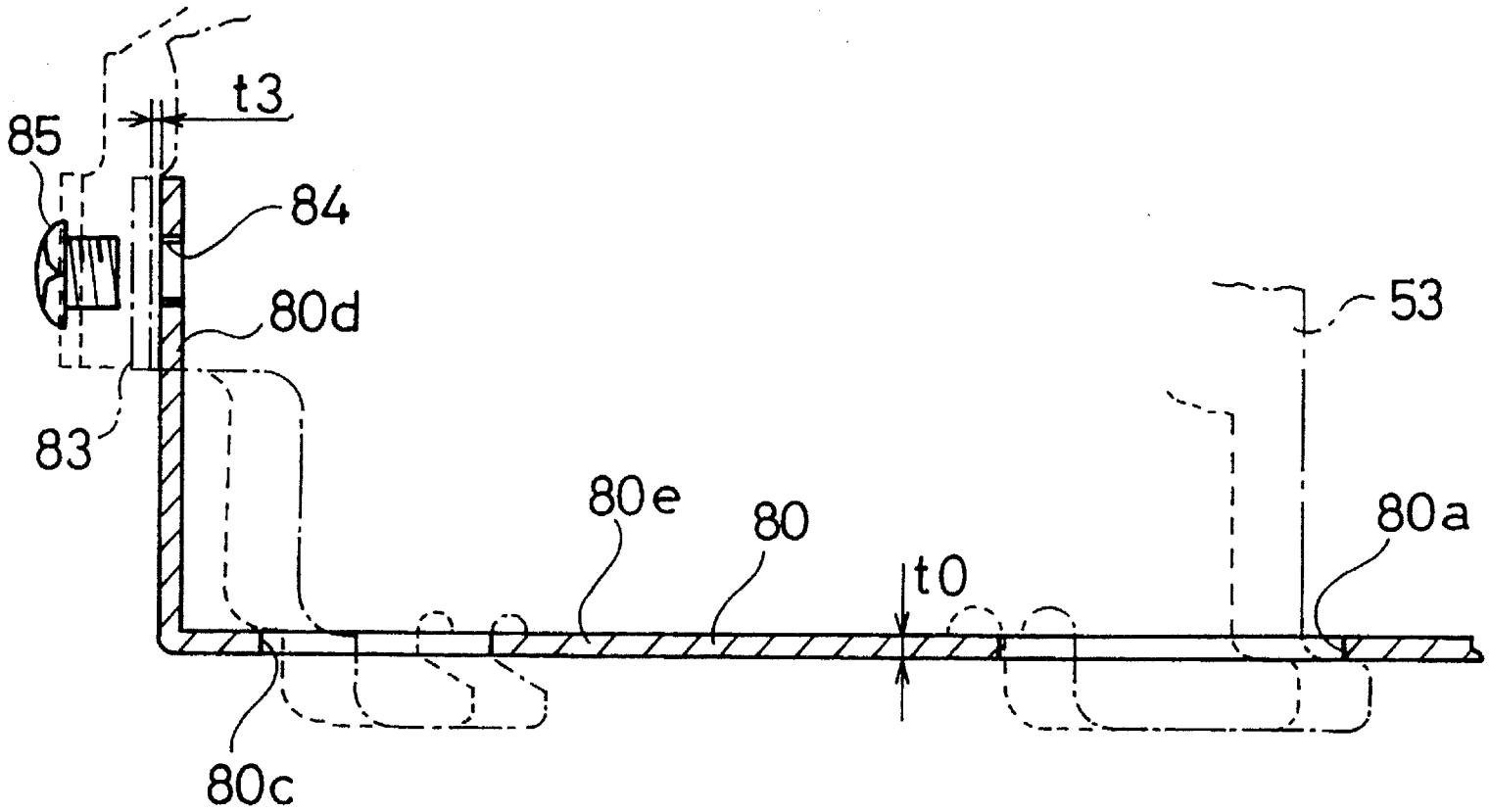
FIG. 10 is a sectional view through a mounting frame of the unit.
Figure 11:
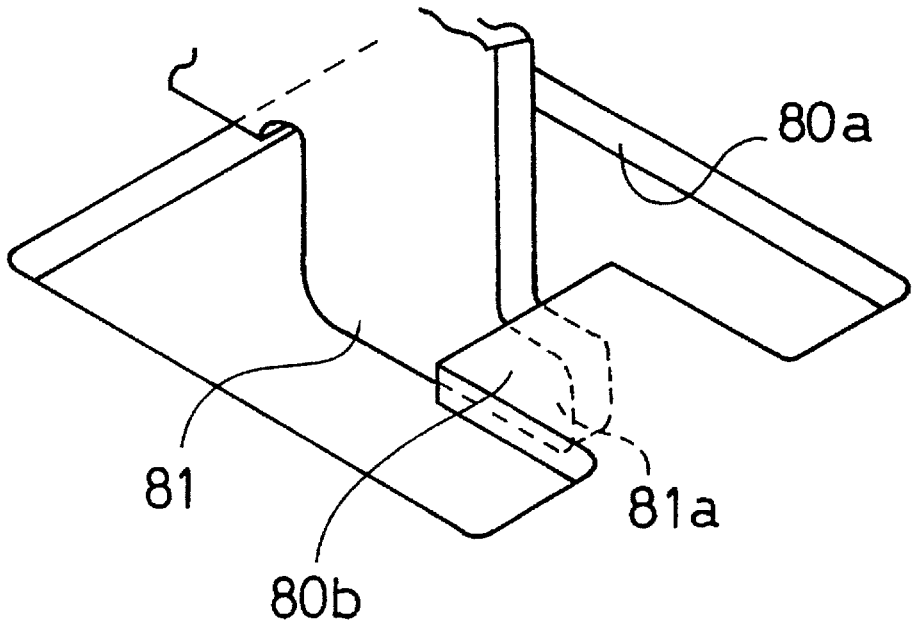
FIG. 11 is a perspective partial view showing a latch portion of the mounting frame.

The image fixing and sheet transporting unit 16 is mounted onto the equipment body by installing the frames 53 disposed at both ends of the unit onto a mount frame 80, shown in FIG. 10. At the bottom end of each frame 53 are first and second hooks 81 and 82 (see FIG. 9); and on the downstream, discharging-side thereof is a flange 83. The mount frame 80 includes a horizontal portion 80*e* into which the frame 53 is placed, and a vertical portion 80*d*. The first hook 81 of the frame 53 includes a projection 81*a* projecting toward the image printing unit and its upper corner is curved. The first hook 81 is inserted into a cutout 80*a* formed in the mount frame 80. Referring to FIG. 11, a latch portion 80*b* protruding into the cutout 80*a* is formed in the mount frame 80, wherein the projection 81*a* of the first hook 81 can abut on the latch portion 80*b*. The latch portion 80*b* is elastically deformable within a predetermined range. Relation of a distance t1 between the upper surface of the projection 81*a* and the under surface of the frame 53 (see FIG. 9), to a thickness t0 of the mount frame 80 (see FIG. 10) is as follows:

$$t0>t1 \text{ (e.g., } t0=1.2 \text{ mm; } t1=1.15 \text{ mm)}$$

Therefore, when the first hook 81 abuts on the latch portion 80*b*, the tip thereof is elastically deformed upward.

Likewise, the second hook 82 includes a projection 82*a* projecting toward the first hook 81. The upper surface 82*b* of the projection 82*a* inclines downward. A cutout 80*c* is formed in the mount frame 80 corresponding to the second hook 82. The cutout 80*c* is formed large enough that the second hook 82 can be entirely inserted into it at once. In addition, relation of a distance t2 between the base of the inclined surface 82*b* and the under surface of the frame 53 (see FIG. 9), to the thickness t0 of the mount frame 80 (see FIG. 10) is as follows:

$$t0<t2 \text{ (e.g., } t0=1.2 \text{ mm; } t2=1.3 \text{ mm).}$$

The vertical portion 80*d* is bent upward from an end of the horizontal portion 80*e*. A threaded hole 84 is formed in the vertical portion 80*d*, wherein the flange 83 of the frame 53 is mounted by a screw 85. As indicated by the dotted line in FIG. 10, when the image fixing and sheet transporting unit 16 is installed into the mount frame 80, abutting the second hook 82 against the corresponding edge the cutout 80*c* of the mount frame 80, a small gap t3 (e.g., 0.1 to 0.5 mm) is left between the flange 83 and the vertical portion 80*d*.

When the image fixing and sheet transporting unit 16 including the frames 53 is installed into the mount frame 80 of the image forming equipment body, first, both hooks 81 and 82 of each frame 53 are inserted into the cutouts 80*a* and 80*c* of the mount frame 80. Then, the frame 53 is moved rightward in FIG. 10, wherein the projection 82*a* of the second hook 82 is guided downward as its inclined surface 82*b* rides on the edge of the cutout 80*c*. The projection 81*a* of the first look 81 goes under the latch portion 80*b*. Thus, the image fixing and sheet transporting unit 16 can be temporarily set in the vertical direction merely by shifting the frame 53 laterally.

When the unit 16 is temporarily set, the gap t3 is left between the vertical portion 80*d* of the mount frame 80 and the flange 83 of the frame 53. In this state, if the screw 85 is screwed down tight into the threaded hole 84, the flange 83 is deflected and adhered immediate the vertical portion 80*d*. Thus, the fixing and transporting unit 16 is stably fixed to the mount frame 80 by the elastic force arising from the deflection of the flange 83.

By utilizing the above-described frame 53 and mount frame 80, even wherein the frame 53 cannot be fixedly set from above, which is the mounting direction, by screws, it can be nonetheless be readily positioned and securely mounted.

Figure 12:
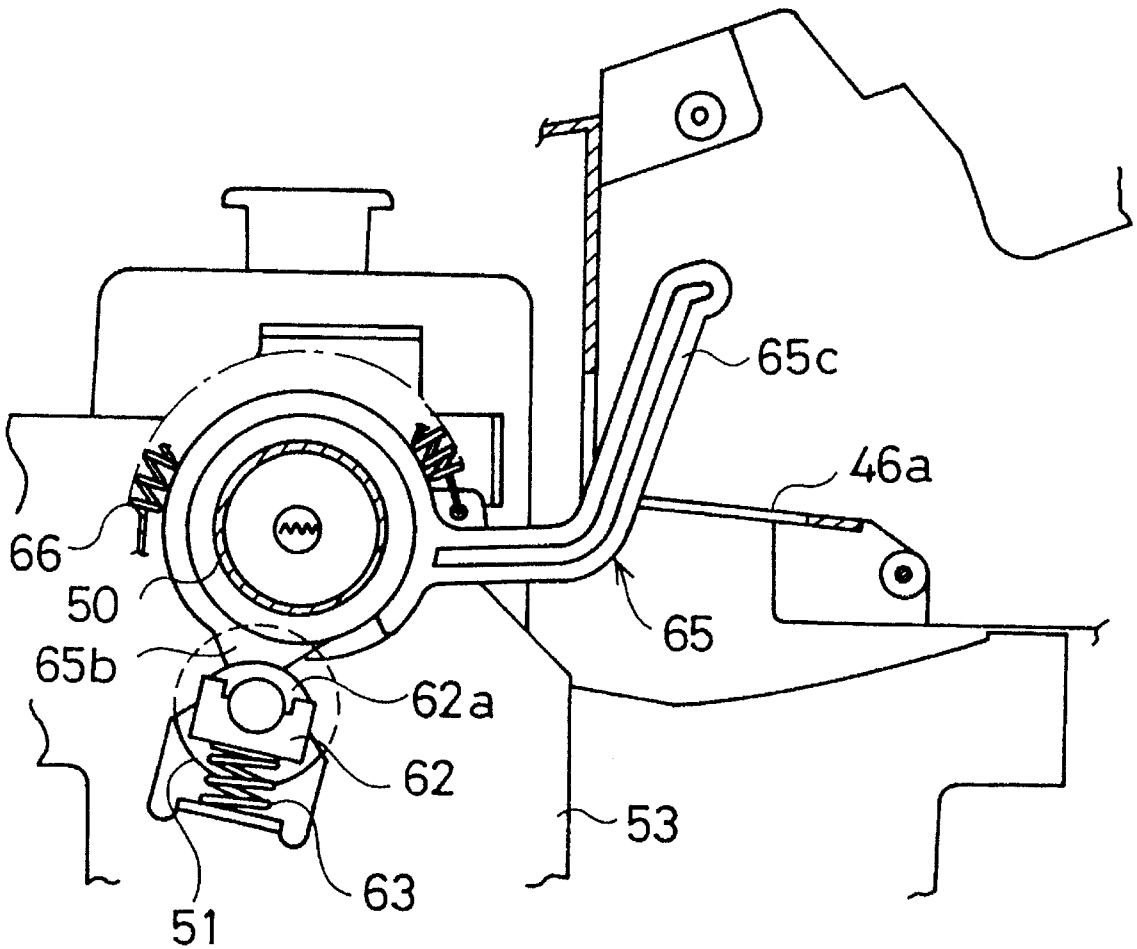
FIG. 12 is an elevational view showing the unit when in position for shipping.

In the state in which the imaging unit 11 is not in installation, for example when shipped, as shown in FIG. 12 according to the above embodiment of the present invention, the lever arms 65*c* of the pressure releasing lever 65 are passed through the cutouts 46*a* of the middle frame 46, rotated upward. Therefore, the lever arms 65*c* are turned counterclockwise in FIG. 12 by the impelling force of the spring 66. In this state, the cam 65*b* of the pressure releasing lever 65 is forced into abutment on the knob 62*a* of the pressure roller 51 bearing 62, pushing it and thus pressure roller 51 downward against the impelling force of the spring 63, thereby separating the pressure roller 51 from the heating roller 50.

Meanwhile, when the image forming equipment of the facsimile terminal is set up, the upper case 25 is opened and the imaging unit 11 is installed. Then, when the upper case 25 is closed, as shown in FIG. 3, the lever arms 65*c* of the pressure releasing lever 65 are pushed downward by the bottom surface of the housing 30 containing the imaging unit 11. Therein, the pressure releasing lever 65 is rotated clockwise in FIG. 3 against the elastic force of the spring 66, turning (each) cam 65*b* off of the bearing 62 knobs 62*a* supporting the pressure roller 51. Thereupon, the pressure roller 51 is impelled upward by the spring 63, whereby the rollers 50 and 51 are pressed together.

Furthermore, the bottom portion of the imaging unit 11 is pushed upward by the lever arms 65*c* of the pressure releasing levers 65, locking the retainers 33 of the housing 30 into position abutting on the pins 34. When the imaging unit 11 is to be replaced, the upper case 25 is opened, releasing pressure from the lever arm 65*c* such that a gap between the photoconductive drum 35 and the developing roller 12 is increased, preventing collision between the developing roller 12 and the photoconductive drum 35 as the imaging unit 11 is installed or dismounted.

Figure 13:
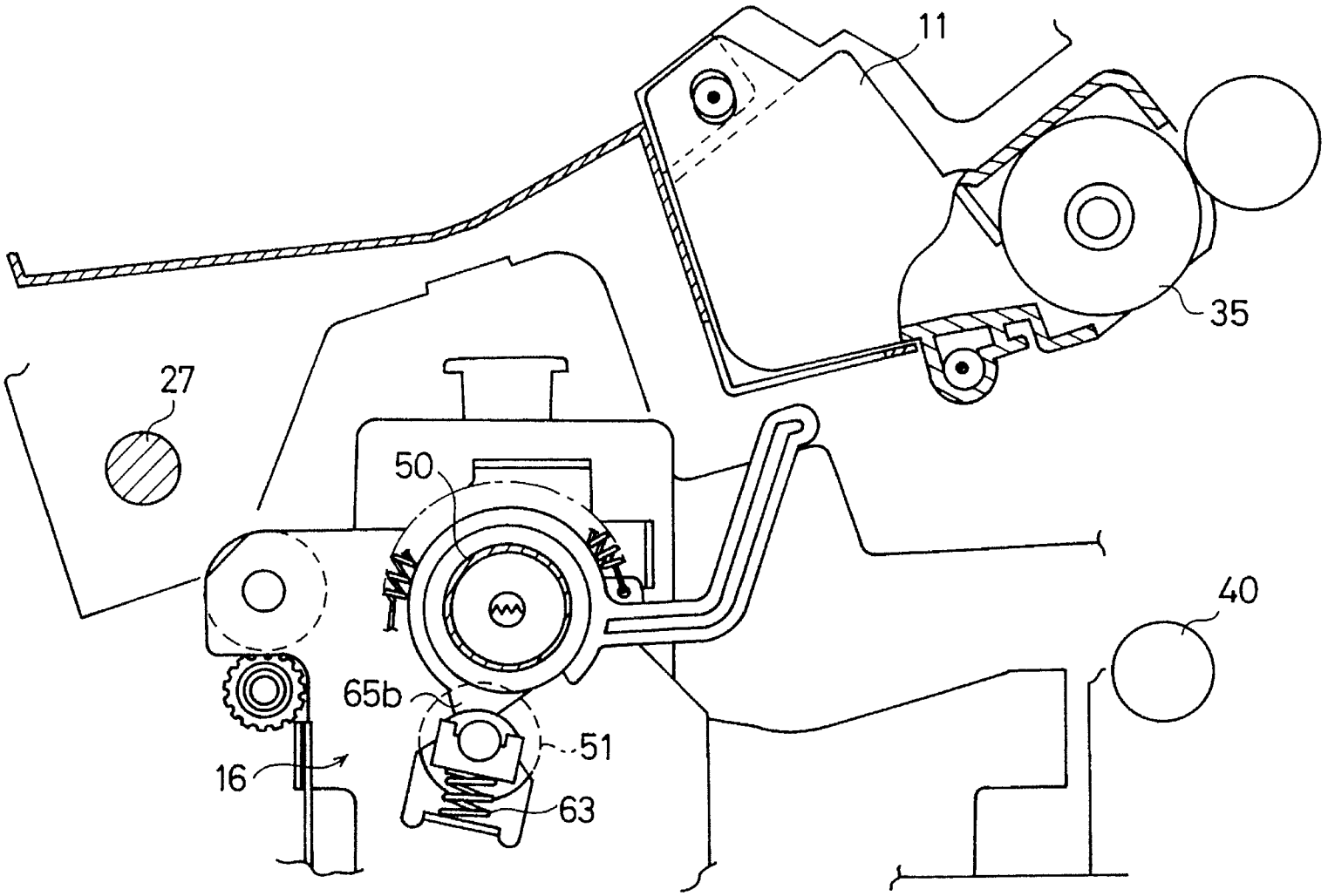
FIG. 13 is an elevational view showing a positioning of the unit wherein a sheet jam is being remedied.

Thus, since the heating roller 50 is automatically pressed against the pressure roller 51 through the mounting operation of the imaging unit 11, setting up time is reduced in comparison with conventional equipment using, for example, a shipping spacer to separate the rollers. Additionally, problems caused by error in installation are avoided. Furthermore, since the rotation center of the pressure releasing lever 65 coincides with the axis of the heating roller 50, a center rod for the lever 65 is not necessary, thereby simplifying the pressure-releasing mechanism. Moreover still, providing the cam 65*b* with a gentle slope separates the roller pair with a small force through the rotation of the pressure-releasing mechanism.

Wherein a sheet becomes jammed in the image fixing and sheet transporting unit 16, the upper case 25 is opened as shown in FIG. 13. In this case, since the bottom surface of the housing 30 of the imaging unit 11 is parted from the ends of the lever arms 65*c* of the pressure releasing levers 65, the pressure releasing lever 65 is rotated counterclockwise in FIG. 3, as is likewise the case wherein the imaging unit 11 is not in installation. The cam 65*b* thus forces the pressure roller 51 apart from the heating roller 50. In this state, the sheet jammed in the image fixing and sheet transporting unit 16 can be easily removed.

Henceforth, a sheet image-printing and transport operation will be described.

When the facsimile terminal receives information, the laser unit 15 optically discharges the electrostatically charged surface of the photoconductive drum 35, forming a corresponding latent image thereon. The electrostatic latent image is developed as a toner image by the developing unit 14. The toner image is transferred onto the surface of the printing sheet by the transfer roller 40.

The sheet is introduced into the image fixing and sheet transporting unit 16 along the sheet transport guide 45. Meanwhile, positively charged residual toner has collected in the residual toner container 37 of the imaging unit 11 housing 30. The sheet in being passed through the transfer roller 40 is charged with electricity of polarity opposite that of the toner. If the transfer guide 45 were a good conductor, it would abruptly drain the electric charge on the sheet, breaking adhesion of the unfixed toner to the sheet, and thus damaging in transport the image carried on its surface. In this embodiment of the present invention, however, since the sheet transport guide 45 is formed of a resin having controlled conductivity, the superficial resistivity being within the range previously mentioned, the electric charge on the sheet is drained only gradually through the sheet transport guide 45. Thus, damage to the unfixed toner image is prevented. In this embodiment particularly, since the sheet transport guide 45 is of greater length, wherein its surface resistivity is set at the specified value, damage to the unfixed toner-printed image due to abrupt draining of the electric charge during transportation is prevented.

Residual toner collected in the container 37 of the housing 30 is positively charged. In addition, since the middle frame 46 is grounded, the middle frame 46 is negatively charged by electrostatic induction. Since the negative charge on the sheet traveling on the sheet transport guide 45 drains gradually as described above, electrostatic attraction between the sheet and the residual toner in the container 37 is reduced, whereby the sheet is prevented from curling upward. Consequently, sheet transport is stabilized.

The thus transported sheet is guided to the transport guide 52*e* and the guide 71*a* of the catch 71 in the upper housing 52, wherein it is introduced between the heating roller 50 and the pressure roller 51. The sheet is then heated between the rollers 50 and 51 at a set pressure thereby fixing the toner image onto the surface of the sheet.

In this fixing operation, since the sheet normally contains a large amount of water and the thermal roller is heated to 150° C. or more, vapor is generated from the sheet in passing the heating roller 50. If this vapor reaches the partition 47 wherein the image forming equipment has not sufficiently warmed up, dew condensation forms along the underside of the dihedral surfaces 47*a* and 47*b* and collects on the collecting surface 47*c* over the mounting member 54. Then condensation then drops from the collecting surface 47*c*, and is collected into the channel 54*a* of the mounting member 54.

The channel 54*a* of the mounting member 54 is immediate the heating roller 50. Therefore, wherein the printing operation continues, the water in the recess 54*a* is evaporated by heat from the heating roller 50. By this time, since the image forming equipment has warmed up sufficiently, any vapor reaching the partition 47 again will not condense into dew.

If the water storing capacity of the mounting member 54 channel 54*a* is sufficient to enable it to store the greatest quantity of dew condensation therein possible under normal operating conditions, no waterdrops will fall onto other items, such as the surface of the printing sheet, ensuring that water damage to the image is prevented. Moreover, employing the partition 47 and the mounting member 54, eliminates the need to use a special element such as a hygroscopic material.

After the printing sheet has undergone the image fixing operation, it is separated from the heating roller 50 by the separating claws 57 and then discharged onto the discharge tray by the discharge rollers 75 and 76. Therein, the trailing edge of the sheet enters a groove 76*a* of the lower roller 76, as shown in FIG. 8. Since the adjacent side of the groove 76*a* makes an acute angle with the line tangent to the cylindrical periphery, the trailing edge of the sheet further enters inside the groove 76*a* following the rotation of the lower roller 76. Thereby, the sheet is securely discharged into the discharge tray 17. In addition, since the cylindrical surface of the lower roller 76 is arched, the sheet is further protected from being damaged.

[Embodiment]

Results of an experiment in which curling-up states of the printing sheet were evaluated by changing the resin material of the sheet transport guide 45 are shown in the following Table 1. If the superficial resistivity were less than $1\times10^{10}\Omega$, since the sheet transport distance is longer in the embodiment of the present invention, the image would likely be damaged. Thus, according to the following Table 1, a material whose resistivity is $1\times10^{11}\Omega$ or more is preferable.

TABLE 1

| MATERIAL NAME | SUPERFICIAL RESISTIVITY | STATE OF SHEET |
|---|---|---|
| General ABS (TOYOLAC 100) ABS Group | $1\times10^{15}\Omega$ | UNACCEPTABLE (Curling up) |
| Permanent Electrostatic-Supressing Resin (TOYOLACPAREL TP10) | $1\times10^{11}\Omega$ | SATISFACTORY (No Curling) |
| General ABS (JAPAN SYNTHETIC RUBBER INC. ABS 12) ABS Group | $1\times10^{16}\Omega$ | UNACCEPTABLE (Curling up) |
| Antistatic Grade (JAPAN SYNTHETIC RUBBER INC. ABS EM12) | $1\times10^{11}\Omega$ | SATISFACTORY (No Curling) |

[Modifications]

(a) Although the lever arm 65*c* or the pressure releasing lever 65 abuts directly on the bottom surface of the housing 30 containing the imaging unit 11 in the foregoing embodiment of the present invention, it may abut on another member.

Figure 14:
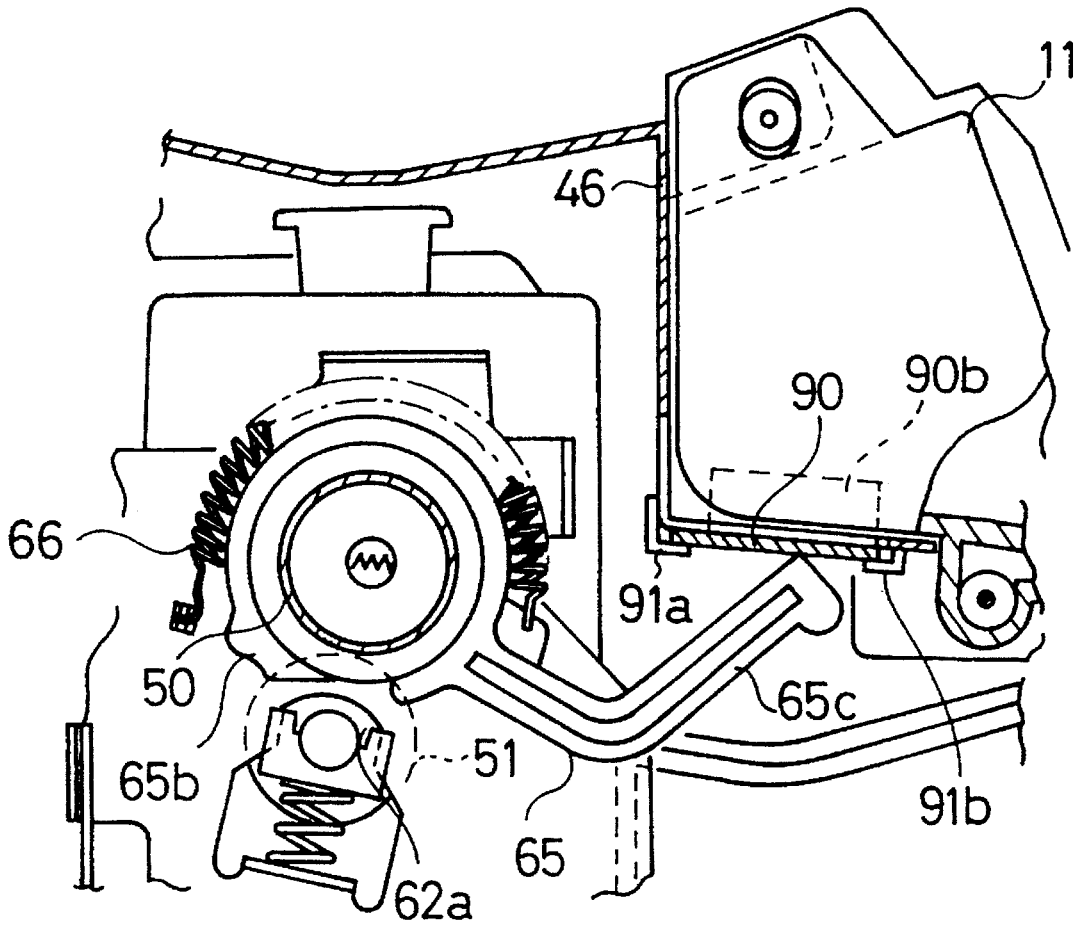
FIG. 14 is an enlarged elevational partial view illustrating a portion of an image fixing and sheet transporting unit according to another embodiment of the present invention.
Figure 15:
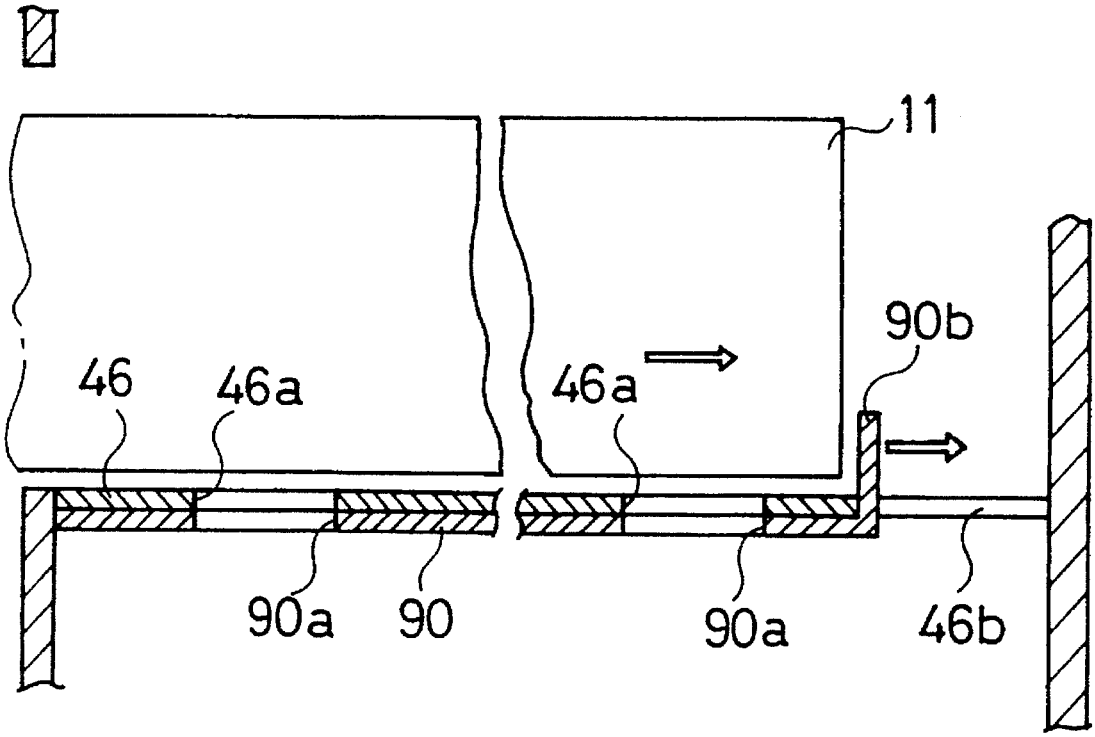
FIG. 15 is a partial end view corresponding to FIG. 14.

According to an embodiment of the present invention as shown in FIGS. 14 and 15, a shutter member 90 is movably disposed under the middle frame 46. The shutter member 90 is supported by guides 91*a* and 91*b* provided on the lower surface of the middle frame 46 and is movable in the axial direction of the heating roller 50. A pair of cutouts 90*a* is formed in portions of the shutter member 90 corresponding to the cutouts 46*a* of the middle frame 46. Each cutout 90*a* is almost the same size as the cutout 46*a*. Therefore, the cutout 46*a* of the middle frame 46 coincides with the cutout 90*a* of the shutter member 90 in the position shown in FIG. 14, whereby the lever arm 65*c* can pass through both cutouts 46*a* and 90*a*. Furthermore, an upward projecting bracket 90*b* projecting is formed at one end of the shutter member 90. When the imaging unit 11 is installed into the image forming equipment body, the adjacent end of the imaging unit 11 abuts on the bracket 90*b* of the shutter member 90 such that the shutter member 90 is moved in the direction indicated by the arrow in FIG. 15. Thereupon, the cutout 46*a* of the middle frame 46 is shifted off of the cutout 90*a* of the shutter member 90, and the lever arm 65*c* abuts on the shutter member 90 wherein it cannot rotate upward.

In this state, as shown in FIG. 14, the cam 65*b* of the pressure releasing lever 65 is separated from the bearing knob 62*a* supporting the pressure roller 51 and then, allowing the rollers 50 and 51 to be pressed together.

If the imaging unit 11 is of low rigidity, wherein the lever arm 65*c* of the pressure releasing lever 65 abuts directly on the imaging unit 11 as in the above-described embodiment of the present invention, the imaging unit 11 might be deformed by elastic force of the spring 66, which can have an adverse effect upon image formation.

In the embodiment of the present invention shown in FIGS. 14 and 15, however, the lever arm 65*c* abuts on the shutter member 90 and does not directly abut on the imaging unit 11. Therefore, even if the rigidity of the imaging unit 11 is low, the pressure roller 51 is automatically separated from the heating roller 50 without risk of adverse consequences upon image formation.

Figure 16:
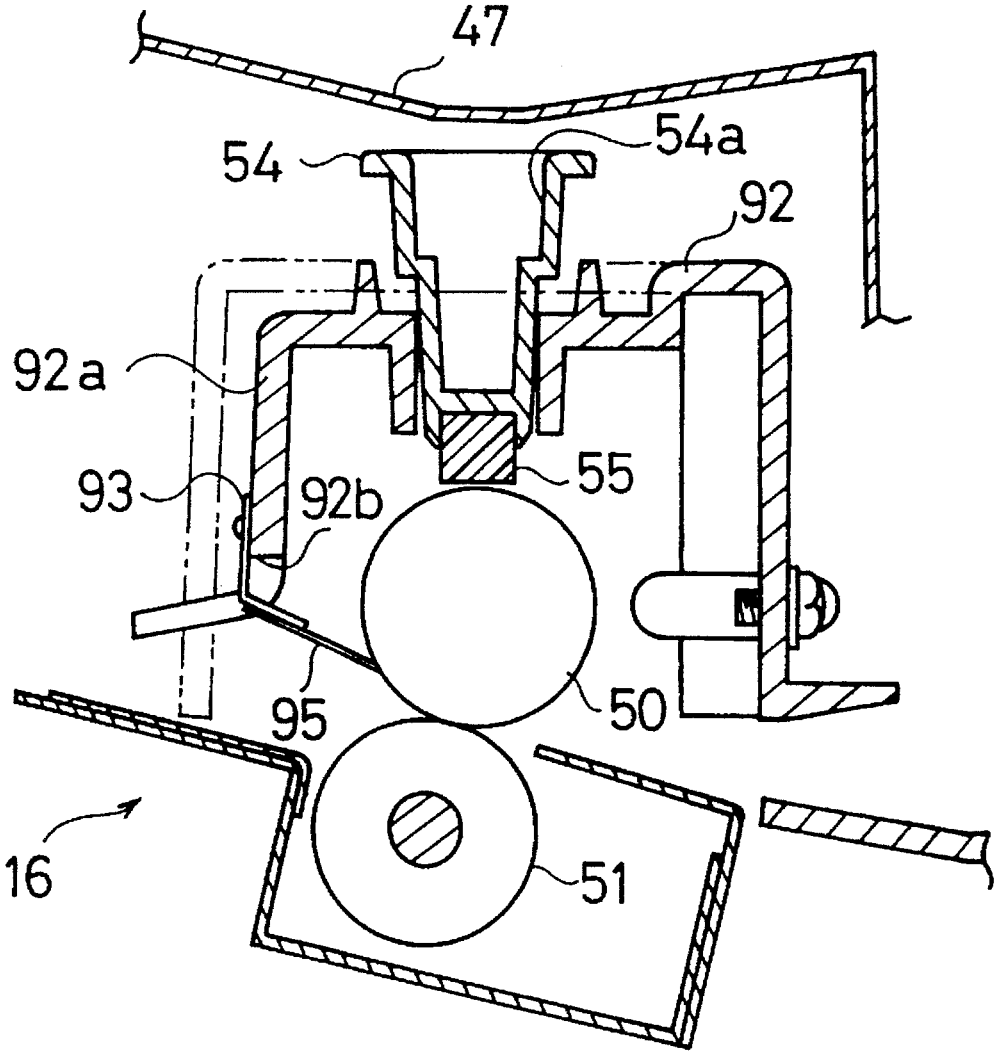
FIG. 16 is a partial view in vertical section of an image fixing and sheet transporting unit according to a further embodiment of the present invention.
Figure 17:
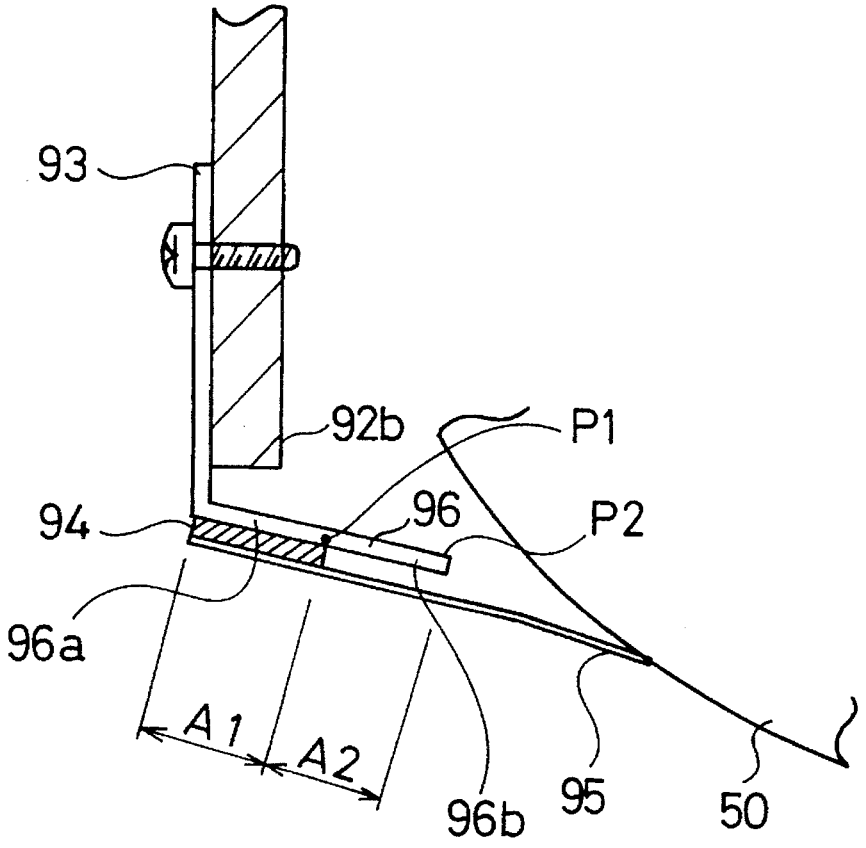
FIG. 17 is a detailed partial enlargement corresponding to FIG. 16.
Figure 18:
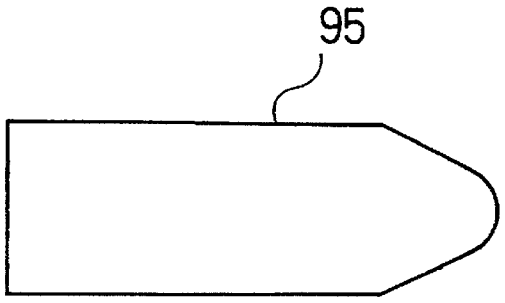
FIG. 18 is a bottom view of a separating claw illustrated in FIG. 17.

(b) Another embodiment of the present invention directed to the separator claw for separating the printing sheet from the thermal roller is shown in FIGS. 16 to 18.

According to this embodiment of the present invention, a cutout 92*b* is formed in a lateral wall 92*a* on the downstream, sheet-discharging side of upper housing 92. An L-shaped support member 93 is fixed to the lateral wall 92*a*. A lower portion 96 of the support member 93 passes through the cutout 92*b* and extends into the upper housing 92. A bottom end of a separator claw 95 for separating the sheet from the thermal roller is adhered by an adhesive agent 94 to a fixing portion 96*a* (region A1) which is the downstream half of the lower portion 96 of the support member 93. An extension 96*b* (region A2) which is the remaining half of the lower portion 96, upstream toward the sheet-incoming side is disposed at a predetermined distance from the separating claw 95.

The separating claw 95 is formed of a heat resistant resin sheet such as polyimide and the lower surface thereof opposite the sheet is coated with a fluorocarbon resin. The upper surface of the separating claw 95 is uncoated since it is adhered to the fixing portion 96*a*. The separating claw 95 is preferably 70 μ to 250 μ in thickness. The tip of the separating claw 95 tapers to an arc and is elastically in contact with the surface of the heating roller 50. Therefore, this ensured that even if the mounting position of the separating claw 95 is moved, the tip end of the separating claw 95 will abut on the surface of the heating roller 50 at one point to strip the printing sheet smoothly off the heating roller 50.

According to the above embodiment of the present invention, the printing sheet which tended to wind around the heating roller 50, is separated therefrom by the separating claw 95 and then transported toward the discharge roller. Therein, the pressing force of the separating claw 95 against the thermal roller, which can be relatively small, is determined by the distance between a support point P1, which is the end of the fixing portion 96*a*, and the tip end of the separating claw 95. Thus, the heating roller 50 is not likely to be worn away, prolonging its life.

Moreover, wherein the printing sheet is stiff, or wherein it becomes jammed, the separating claw 95 is pushed upward and the middle portion thereof abuts on a support point P2, which is the end of the extension portion 96*b*. In this case, the elastic force of the separating claw 95 is determined by the relatively short distance between the support point P2 and the tip end of the separating claw. Thus, relatively strong force is needed to deflect the separating claw 95 further upward. More specifically, by means of the separating claw 95 and the supporting member 93, the separating claw is prevented from being curled upward, 95 without increase in the pressing force of the separating claw, on the thermal roller 50.

Since the lower surface of the separating claw 95 is coated with fluorine, the separating claw is not likely to be polluted by the toner nor by paper powder. As a result, stable separating performance is obtained over a long period of time.

Figure 19:
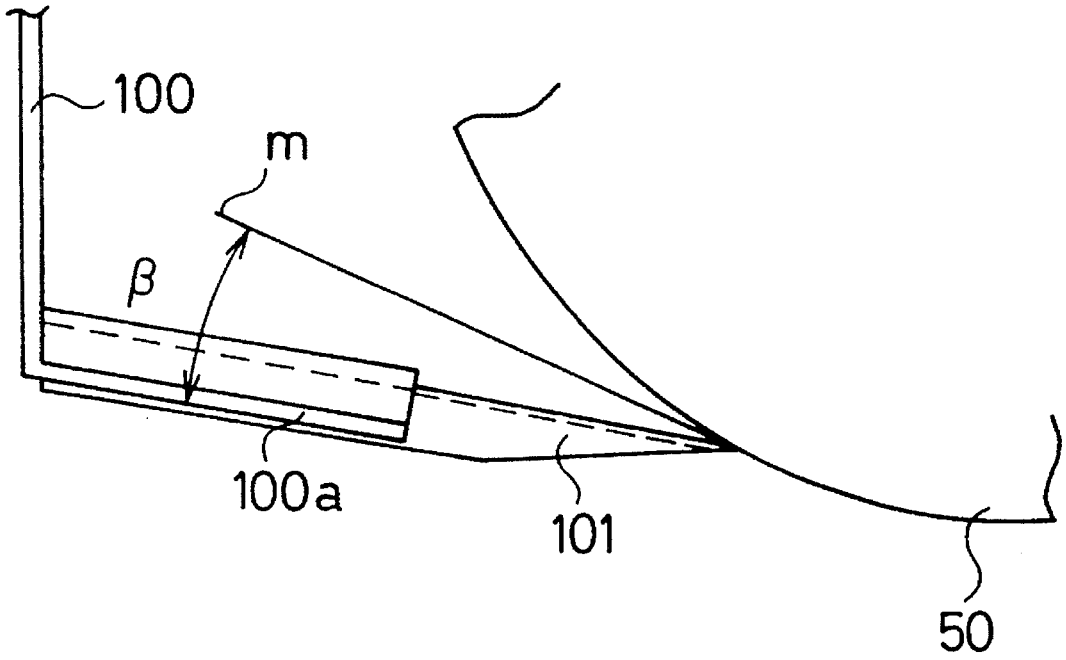
FIG. 19 is a view in detailed partial enlargement illustrating part of an image fixing and sheet transporting unit according to a still further embodiment of the present invention.
Figure 20:
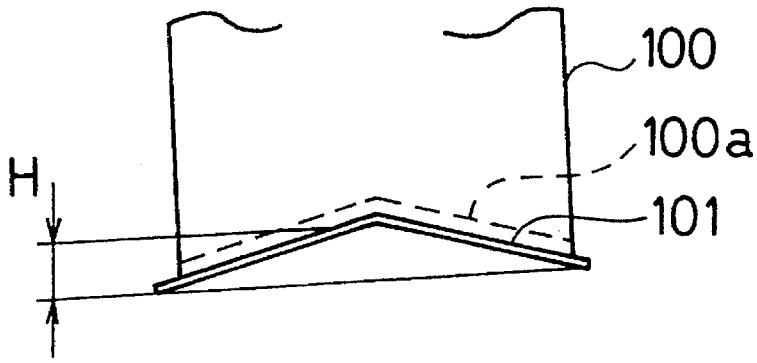
FIG. 20 is a end view corresponding to FIG. 19.
Figure 21:
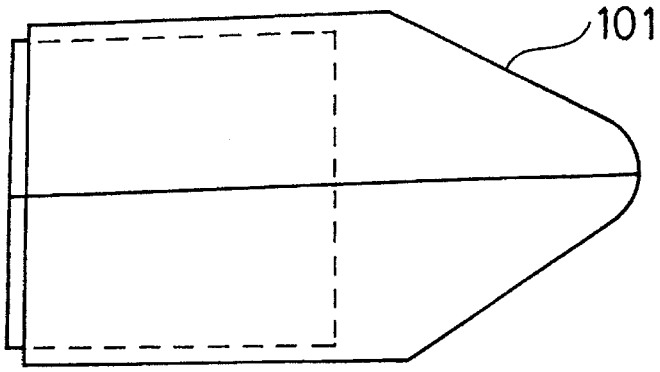
FIG. 21 is a bottom view corresponding to FIG. 20.

(c) A separating claw according to still another embodiment of the present invention is shown in FIGS. 19 to 21.

According to this embodiment of the present invention, an under surface 100*a* of a support member 100 is cut in an inverted V as shown in FIG. 20, in which the center thereof is higher than either edge by H. A separating claw 101 is also shaped in an inverted V along the lower portion 100*a* of the support member 100. The tip end of the separating claw 101 tapers into an arc as shown in FIG. 21. The separating claw 101 is mounted in such a manner that an angle β (which is formed between the separating claw 101 and a tangent line of the heating roller 50) is in the range $5° < \beta < 45°$.

In this embodiment, since the separating claw 101 is bent in such a manner that the center thereof is higher, the elastic force pressing it to the heating roller 50 is greater than elastic force effective in the direction tending to part it from the heating roller 50, whereby the separating claw 101 is prevented from being curled upward, without increasing the force pressing it to the heating roller 50.

In addition, since the separating claw 101 is in contact with the heating roller 50 at the angle β ($5° < \beta < 45°$), even wherein the printing sheet is thick or stiff, the sheet is smoothly stripped from the heating roller 50.

The shape of the separating claw 101 is not limited to the example shown in FIG. 20, and may be bent in an arc, for example.

Figure 22:
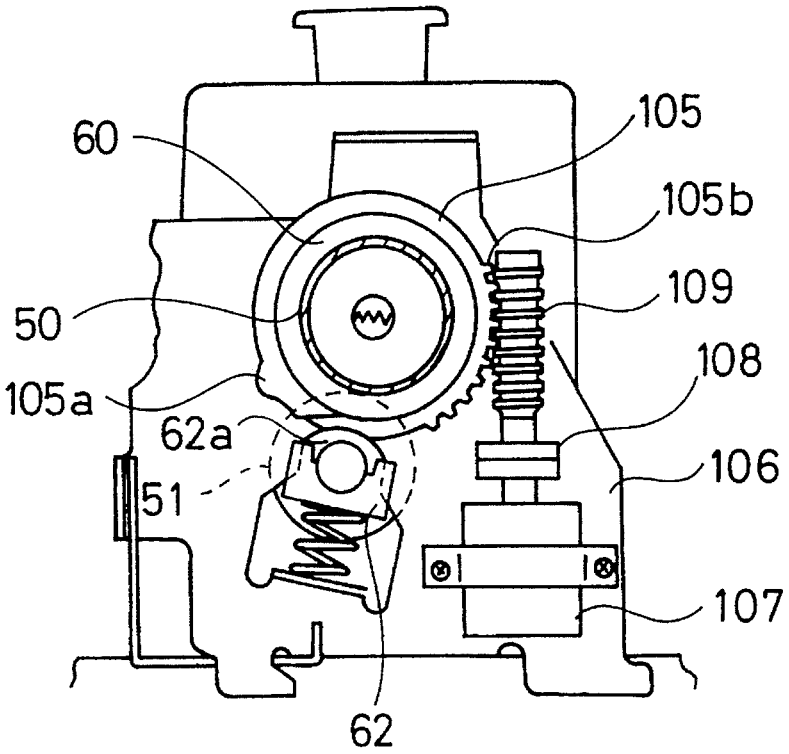
FIG. 22 is a partial elevational view showing part of an image fixing and sheet transporting unit according to a still further embodiment of the present invention.

(d) Although the pressure releasing lever is rotated by pressing force from the imaging unit 11 or the like in installation in the foregoing embodiments of the present invention, it may be rotated by a driving mechanism such as a motor and a gear train as shown in FIG. 22.

According to the embodiment shown in FIG. 22, a pressure releasing member 105 is rotatably disposed peripherally around the bearing 60 supporting the heating roller 50 and circumferentially carries a cam 105*b* for pressing the knob 62*a* of the pressure roller 51 bearing 62. In addition, a gear portion 105*b* is formed in the circumferential periphery of the pressure releasing member 105. Furthermore, a motor 107 is fixed to the frame 106 and a worm gear 109 is connected to an end of the shaft of the motor 107 through a coupler 108. The worm gear 109 is engaged with the gear portion 105b of the pressure releasing member 105.

According to the above embodiment of the present invention, the pressure releasing member 105 can be rotated around the heating roller 50 by rotation of the worm gear 109 by the motor 107. Therefore, when the cam 105*a* of the pressure releasing member 105 is brought into abutment on the bearing knob 62*a* following the rotation of the pressure releasing member 105, the pressure roller 51 is separated from the heating roller 50.

According to the above embodiment of the present invention, since a lever is not necessary, the heating roller 50 and the pressure roller 51 can be easily pressed together or separated in compact small space.

Figure 23:
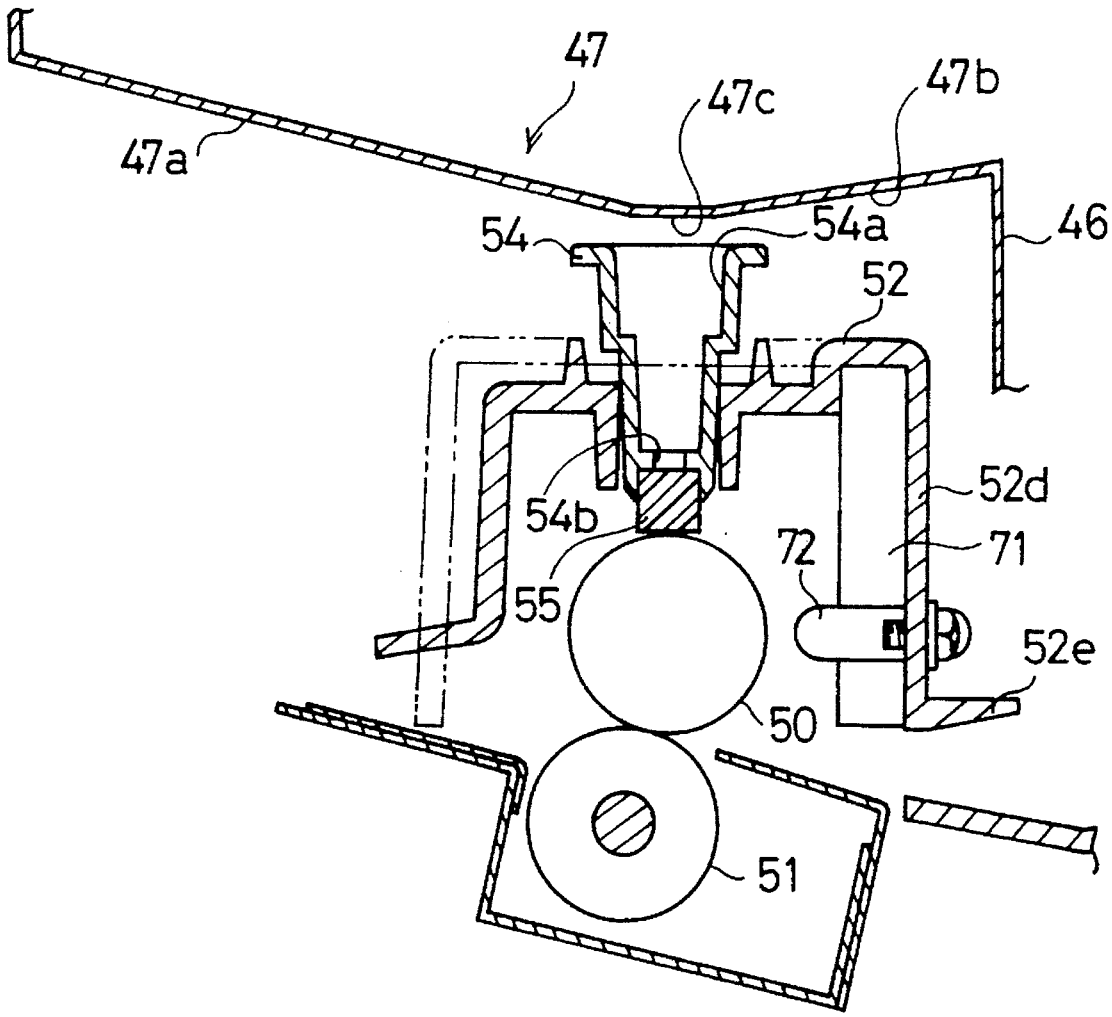
FIG. 23 is a partial view in vertical section of an image fixing and sheet transporting unit according to a still further embodiment of the present invention.

(e) Referring to FIG. 23, a hole 54*b* may be formed in a portion of the bottom of the channel 54*a* of the mounting member 54.

According to the above embodiment of the present invention, water condensation dropping into the channel 54*a* passes through the hole 54*b* and soaks into the cleaning member 55. Since the cleaning member 55 is in contact with the surface of the heating roller 50, it is heated, thus quickly evaporating the water condensation.

Figure 24:
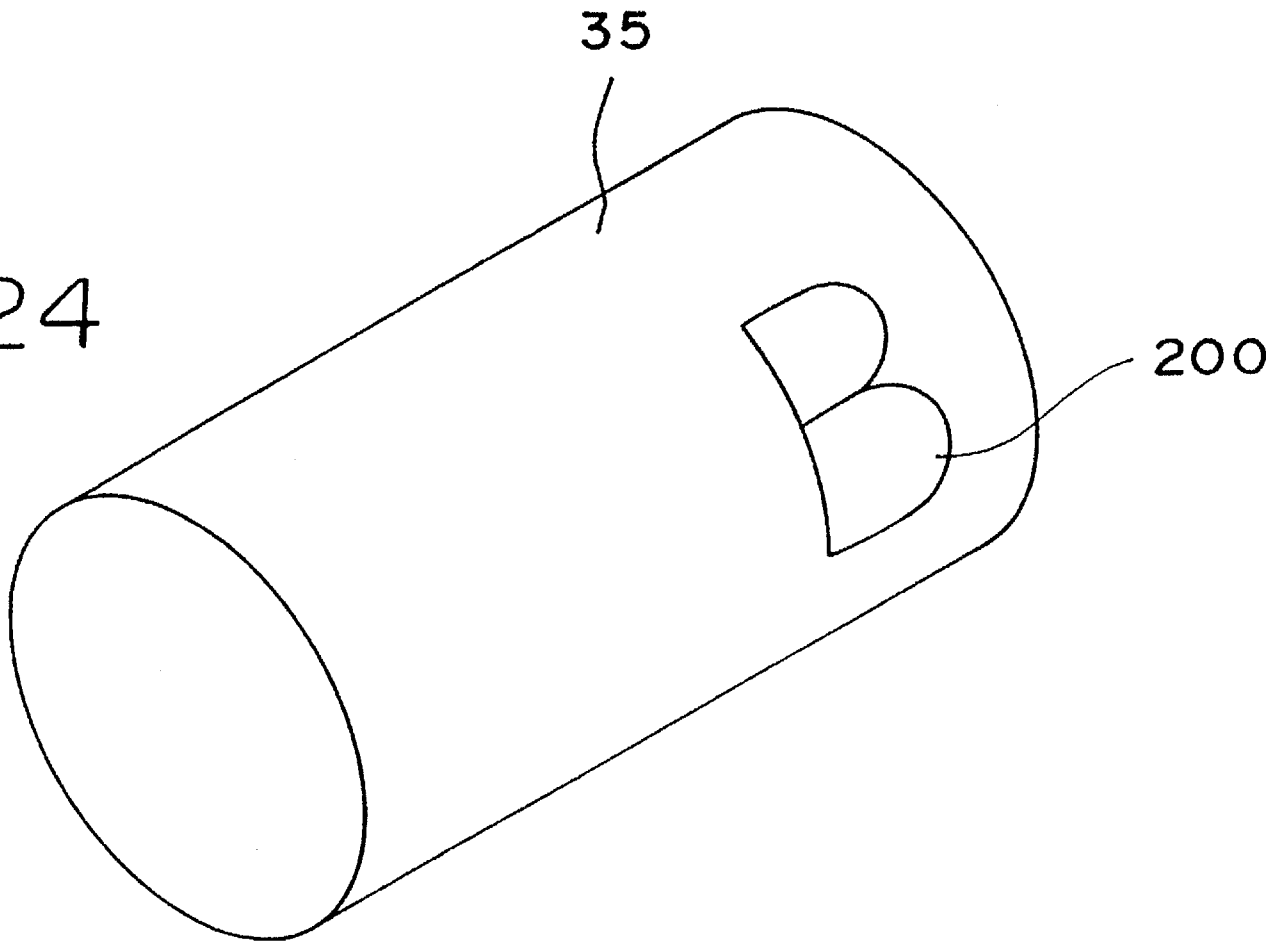
FIG. 24 is a view of a photosensitive drum having an image formed thereon.

FIG. 24 shows a photosensitive drum 35 removed from the image unit 11 (not shown), an having an image 200 formed thereon.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A xerographic printing and sheet processing apparatus comprising:

an image printing apparatus for printing onto a sheet an image developed with magnetic toner from a latent image;

a residual toner container for collecting toner residual from said image printing apparatus;

an image fixing unit, disposed downstream of said image printing apparatus, for fixing the toner developed image superficially onto said sheet; and a transport guide member, disposed in a position opposite said residual toner container, said transport guide member consisting of a member formed of a resin having a surface resistivity ranging from $1\times10^{10}\ \Omega$ to $1\times10^{14}\ \Omega$, and extending from said image printing apparatus to a sheet inlet of said image fixing unit, wherein said transport guide member guides the sheet onto which the toner developed image is printed from said image printing apparatus to said image fixing unit.

2. The xerographic printing and sheet processing apparatus according to claim 1, wherein said residual toner container is disposed downstream of said image printing apparatus.

3. The xerographic printing and sheet processing apparatus according to claim 2, wherein said residual toner carries electric charge of a predetermined polarity, and said sheet as discharged from said image printing apparatus is electrically charged to have a polarity opposite said predetermined polarity of said residual toner.

4. The xerographic printing and sheet processing apparatus according to claim 3, wherein said transport guide member is disposed adjacently beneath said residual toner container; wherein said printing and sheet processing apparatus further includes a grounded conductive material disposed immediately adjacent said residual toner container and above said transport guide member.

5. The xerographic printing and sheet processing apparatus according to claim 4, wherein said image printing apparatus comprises an imaging unit including:

a photoconductive drum; and a housing encasing said photoconductive drum and defining said residual toner container downstream thereof.

6. The xerographic printing and sheet processing apparatus according to claim 3, wherein said image printing apparatus comprises:

a photoconductive drum being electrically charged to have negative polarity, for bearing said latent image as a positive image formed thereon by optical discharge; wherein said magnetic toner carries electric charge of positive polarity in developing said latent image; and a transfer roller for transferring said image developed with magnetic toner from said photoconductive drum to said sheet, wherein the polarity of the electric charge on said sheet is negative.

7. In a xerographic printing and sheet processing apparatus of image forming equipment supported on an equipment body frame and including an image printing apparatus detachably installable into said body frame, a sheet transport unit comprising:

a pair of sheet transport mechanisms, positionable into a pressed together position for transporting a sheet, and positionable into a parted position in which the sheet transport mechanisms are separated from each other; and sheet transport mechanism positioning means for maintaining said pair of sheet transport mechanisms in said parted position when said image printing apparatus is withdrawn from said body frame; and for bringing said pair of sheet transport mechanisms retentively into said pressed together position, wherein a positioning part of said sheet transport mechanism positioning means abuts on a corresponding portion of said image printing apparatus when said image printing apparatus is installed into said body frame.

8. A sheet transport unit according to claim 7, wherein said pair of sheet transport mechanisms comprises:

a sheet transport mechanism frame;

first and second sheet transport rollers disposed substantially parallel axially;

first transport roller support means for rotatably supporting the first sheet transport roller on said sheet transport mechanism frame; and second transport roller support means for rotatably supporting the second sheet transport roller on said sheet transport mechanism frame;

said second transport roller support means pressing said second sheet transport roller against said first sheet transport roller when said sheet transport mechanisms are positioned in said pressed together position; and said second transport roller support means separating said second sheet transport roller from said first sheet transport roller when said sheet transport mechanisms are positioned in said parted position.

9. A sheet transport unit according to claim 8, wherein said first transport roller support means comprises a first bearing for supporting said first sheet transport roller; and said second transport roller support means comprises a second bearing for supporting said second sheet transport roller so as to be movable toward and away from said first sheet transport roller, and an impelling member for impelling said second bearing toward said first sheet transport roller.

10. A sheet transport unit according to claim 9, wherein said sheet transport mechanism positioning means comprises a positioning actuator moving into a separating position when said image printing apparatus is withdrawn from said body frame, and moving into a pressing position when said image printing apparatus is installed into said body frame;

said positioning actuator in said separating position pressing said second bearing against impelling force of said impelling member, thereby separating said second sheet transport roller from said first sheet transport roller; and said positioning actuator in said pressing position allowing said impelling member to press said second sheet transport roller against said first sheet transport roller.

11. A sheet transport unit according to claim 10, wherein said positioning actuator comprises:

a lever rotatably disposed peripherally around and concentric with said first bearing, a portion of said lever abutting on said image printing apparatus to rotate said positioning actuator between said separating and said pressing positions; and a cam, being brought into contact to press said second bearing against said impelling force of said impelling member by a rotation of said positioning actuator into said separating position.

12. A sheet transport unit according to claim 11, wherein said first sheet transport roller is a heating roller for superficially heating the sheet in transport by the unit; and said second sheet transport roller is a pressure roller for pressing said sheet against said heating roller.

13. A sheet transport unit according to claim 7, wherein said equipment body frame of said image forming equipment is housed in an openable upper case and a lower ease; and said image printing apparatus is detachably installed into said body frame in said upper case and said pair of sheet transport mechanisms is mounted in said lower case.

14. A sheet transport unit according to claim 13, wherein said sheet transport mechanism positioning means maintains said pair of sheet transport mechanisms in said parted position when said upper case is opened; and said sheet transport mechanism positioning means maintains said pair of sheet transport mechanisms in said pressed together position when said upper case is closed.

15. A sheet transport unit according to claim 14, wherein when said image printing apparatus is not installed in said upper case, said sheet transport mechanism positioning means maintains said pair of sheet transport mechanisms in said parted position regardless of whether said upper case is closed.

16. A sheet transport unit according to claim 15, wherein said pair of transport mechanisms comprises:

a sheet transport mechanism frame;

first and second sheet transport rollers disposed substantially parallel axially;

first transport roller support means for rotatably supporting the first sheet transport roller on said sheet transport mechanism frame; and second transport roller support means for rotatably supporting the second sheet transport roller on said sheet transport mechanism frame;

said second transport roller support means pressing said second sheet transport roller against said first sheet transport roller when said pair of said sheet transport mechanisms are positioned in said pressed together position; and said second transport roller support means separating said second sheet transport roller from said first sheet transport roller when said pair of sheet transport mechanisms are positioned in said parted position.

17. A sheet transport unit according to claim 16, wherein said first transport roller support means comprises a first bearing for supporting said first sheet transport roller; and said second transport roller support means comprises a second bearing for supporting said second sheet transport roller so as to be movable toward and away from said first sheet transport roller, and an impelling member for impelling said second bearing toward said first sheet transport roller.

18. A sheet transport unit according to claim 17, wherein said sheet transport mechanism positioning means comprises a positioning actuator moving into a separating position when said image printing apparatus is withdrawn from said body frame, and moving into a pressing position when said image printing apparatus is installed into said body frame;

said positioning actuator in said separating position pressing said second bearing against impelling force of said impelling member, thereby separating said second sheet transport roller from said first sheet transport roller; and said positioning actuator in said pressing position allowing said impelling member to press said second sheet transport roller against said first sheet transport roller.

19. A sheet transport unit according to claim 18, wherein said positioning actuator comprises:

a lever rotatably disposed peripherally around and concentric with said first bearing, a portion of said lever abutting on said image printing apparatus to rotate said positioning actuator between said separating and said pressing positions; and a cam, being brought into contact to press said second bearing against said impelling force of said impelling member by a rotation of said positioning actuator into said separating position.

20. In a xerographic printing and sheet processing apparatus of image forming equipment supported on an equipment body frame and including an image printing apparatus detachably mountable into said body frame, a sheet transport unit comprising:

a pair of sheet transport mechanisms, positionable into a pressed together position for transporting a sheet, and positionable into a parted position in which the sheet transport mechanisms are separated from each other;

a positioning actuator, assuming a first position when said image printing apparatus is withdrawn from said body frame, and a second position when said image printing apparatus is installed into said body frame; and positioning means for maintaining said pair of sheet transport mechanisms in said parted position when said positioning actuator is in said first position; and for bringing said pair of sheet transport mechanisms retentively into said pressed together position, wherein a positioning part of said positioning means abuts on a corresponding portion of said positioning actuator when said positioning actuator is in said second position.

21. A sheet transport unit according to claim 20, wherein said pair of sheet transport mechanisms comprises:

a sheet transport mechanism frame;

first and second sheet transport rollers disposed substantially parallel axially;

first transport roller support means for rotatably supporting the first sheet transport roller on said sheet transport mechanism frame; and second transport roller support means for rotatably supporting the second sheet transport roller on said sheet transport mechanism frame;

said second transport roller support means pressing said second sheet transport roller against said first sheet transport roller when said pair of sheet transport mechanisms are positioned in said pressed together position; and said second transport roller support means separating said second sheet transport roller from said first sheet transport roller when said pair of sheet transport mechanisms are positioned in said parted position.

22. A sheet transport unit according to claim 21, wherein said first transport roller support means comprises a first bearing for supporting said first sheet transport roller; and said second transport roller support means comprises a second bearing for supporting said second sheet transport roller so as to be movable toward and away from said first sheet transport roller, and an impelling member for impelling said second bearing toward said first sheet transport roller.

23. A sheet transport unit according to claim 22, wherein said positioning actuator comprises:

a lever rotatably disposed peripherally around and concentric with said first bearing, a portion of said lever abutting on said image printing apparatus to rotate said positioning actuator between said first position and said second position; and a cam, being brought into contact to press said second bearing against said impelling force of said impelling member by the rotation of said positioning actuator into said first position.

24. A sheet transport unit according to claim 23, wherein said positioning actuator in said first position presses said second bearing against impelling force of said impelling member, thereby separating said second sheet transport roller from said first sheet transport roller; and said positioning actuator in said second position allows said impelling member to press said second sheet transport roller against said first sheet transport roller.

25. A sheet transport unit according to claim 20, wherein said equipment body frame of said image forming equipment is housed in an openable upper case and a lower case; and said image printing apparatus is detachably installed into said body frame in said upper case, and said pair of sheet transport mechanisms is mounted in said lower case.

26. A sheet transport unit according to claim 25, wherein said positioning means maintains said positioning actuator in said first position when said upper case is opened, and maintains said positioning actuator in said second position when said upper case is closed.

27. A sheet transport unit according to claim 26, wherein when said image printing apparatus is withdrawn from said upper case, said positioning means maintains said positioning actuator in said first position regardless of whether said upper case is closed.

28. In an image forming apparatus including an image printing apparatus for printing onto a sheet a toner-developed image, a fixing unit comprising:

image fixing means including a heating roller containing a heating means, for superficially fixing the printing of said toner-developed image onto said sheet, wherein said sheet is supplied from said image printing apparatus;

a fixing unit housing covering said heating roller, said housing covering having a lateral wall immediately adjacent said heating roller, and a fuse catch including two adjacent cutouts defined in said lateral wall of said fixing unit housing; and a temperature fuse electrically connected to said heating means and retainable by said fuse catch so as to leave a predetermined gap between said temperature fuse and said heating roller;

wherein opposite ends of said temperature fuse are laced through said cutouts and fixed to an exterior side of said lateral wall such that said temperature fuse is therein centrally adjacent an interior side of said lateral wall between said cutouts and immediately adjacent said heating roller.

29. A fixing unit according to claim 28, wherein said fixing unit housing includes lateral walls flanking said heating roller and covering respective sheet-incoming and sheet-discharging ends thereof; and an upper wall covering over said heating roller;

wherein said cutouts and said fuse catch are formed in said lateral wall on the sheet-incoming side of said heating roller.

30. A sheet transport unit installable in a xerographic printing and sheet processing apparatus of image forming equipment, comprising:

a first sheet transport mechanism including a circulating first sheet-transport surface and a rotator rod for rotating the first sheet transport surface;

a second sheet transport mechanism including a second sheet transport surface pressible against said first sheet transport surface and separable therefrom, for transporting a printing sheet by pinching the sheet together with said first sheet transport surface;

impelling means for impelling said second sheet transport surface toward said first sheet transport surface;

a cam device carrying a cam, rotatably disposed peripherally around an end of said rotator rod, for separating said second sheet transport surface from said first sheet transport surface against impelling force of said impelling means; and operating means for rotating said cam device.

31. A sheet transport unit according to claim 30, wherein said first sheet transport mechanism comprises a first roller for transporting said printing sheet, and first support means for rotatably supporting said first roller; and said second sheet transport mechanism comprises a second roller for transporting said printing sheet together with said first roller, and second support means for rotatably supporting said second roller such that said second roller is pressible toward and separable from said first roller.

32. A sheet transport unit according to claim 31, wherein said first support means comprises a first bearing for supporting said first roller; said second support means comprises a second bearing for supporting said second roller so as to be movable toward and away from said first roller; and said impelling means impels said second bearing toward said first roller.

33. A sheet transport unit according to claim 32, wherein said cam device is for bringing said cam to press said second bearing away from said first roller.

34. A sheet transport unit according to claim 33, wherein said operating means comprises a lever extending away from a peripheral position of said cam device.

35. A sheet transport unit according to claim 34, wherein upon installation of said sheet transport unit, said lever abuts on a corresponding portion of the image forming equipment such that said cam device is rotated.

36. For a xerographic printing and sheet processing apparatus of image forming equipment, a detachable sheet transport unit mounting structure for pressing a sheet transport unit in one direction and for mounting said sheet transport unit into a body frame of the image forming equipment comprising:

first and second sheet transport rollers disposed substantially parallel axially, positionable into a pressed together position for transporting a sheet, and positionable into a parted position;

a first bearing for rotatably supporting the first sheet transport roller;

a second bearing for rotatably supporting the second sheet transport roller so as to be movable toward and away from said first sheet transport roller, said second bearing pressing said second sheet transport roller against said first sheet transport roller when said first and second sheet transport rollers are positioned in said pressed together position, and said second bearing separating said second sheet transport roller from said first sheet transport roller when said first and second sheet transport rollers are positioned in said parted position;

a pressing mechanism having an impelling member for impelling said second bearing toward said first sheet transport roller; and a pressure releasing member positionable into a first position, for pressing said impelling member so as to separate against impelling force thereof said second bearing from said first sheet transport roller, and positionable into a second position, for allowing said second bearing to be pressed toward said first sheet transport roller by said impelling force.

37. A sheet transport unit mounting structure according to claim 36, wherein said pressure releasing member carries a cam rotatably disposed peripherally around and concentric with said first bearing, said cam being pressible against said second bearing; and said impelling member applies said impelling force along said pressure releasing member when said cam is not in contact with said second bearing.

38. A sheet transport unit mounting structure according to claim 37, wherein said sheet transport unit is vertically movable within a predetermined range in said body frame of said image forming equipment; and said pressure releasing member comprises a lever extending away from a peripheral position thereof and pressing said sheet transport unit upward.

39. For a xerographic printing and sheet processing apparatus of image forming equipment, a detachable sheet transport unit mounting structure for pressing a sheet transport unit in one direction and for mounting said sheet transport unit into a body frame of the image forming equipment, comprising:

a pair of sheet transport members positionable into a pressed together position for transporting a sheet, and positionable into a parted position;

a pressing mechanism for pressing, under impelling force thereof, said pair of transport members together; and a pressure releasing member positionable into a first position, for separating said pair of sheet transport members, and positionable into a second position, for allowing said pair of transport members to be pressed together by said impelling force, wherein said image forming equipment comprises an openable upper case and a lower case; said sheet transport unit is detachably mounted into said upper case; and said pressure releasing member is installed within said lower case.

40. A sheet transport unit mounting structure according to claim 39, wherein said pressure releasing member is put into said first position when said upper case is opened, and put into said second position when said upper case is closed.

41. A sheet transport unit mounting structure according to claim 40, wherein when said sheet transport unit is not mounted in said upper case, said pressure releasing member is put into said first position regardless of whether said upper case is closed.

* * * * *